US011764465B2

(12) United States Patent
Hashiguchi

(10) Patent No.: US 11,764,465 B2
(45) Date of Patent: Sep. 19, 2023

(54) ANTENNA ASSEMBLY AND ELECTRONIC EQUIPMENT

(71) Applicant: Japan Aviation Electronics Industry, Limited, Tokyo (JP)

(72) Inventor: Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 167 days.

(21) Appl. No.: 17/141,447

(22) Filed: Jan. 5, 2021

(65) Prior Publication Data

US 2021/0288396 A1 Sep. 16, 2021

(30) Foreign Application Priority Data

Mar. 11, 2020 (JP) ..... 2020-041791

(51) Int. Cl.

| | |
|---|---|
| ***H01Q 1/38*** | (2006.01) |
| ***H01Q 1/48*** | (2006.01) |
| ***H01Q 9/14*** | (2006.01) |
| ***H01Q 7/00*** | (2006.01) |

(52) U.S. Cl.
CPC ..... *H01Q 1/38* (2013.01); *H01Q 1/48* (2013.01)

(58) Field of Classification Search
CPC ..... H01Q 1/38; H01Q 1/48; H01Q 1/2291; H01Q 1/243; H01Q 9/14; H01Q 1/2258; H01Q 5/378; H01Q 7/00
See application file for complete search history.

(56) References Cited

U.S. PATENT DOCUMENTS

| | | | | |
|---|---|---|---|---|
| 8,872,726 | B2 | 10/2014 | Kusanagi | |
| 9,070,966 | B2 | 6/2015 | Ng et al. | |
| 9,190,729 | B2 | 11/2015 | Liu et al. | |
| 9,627,767 | B2 | 4/2017 | Liu et al. | |
| 2006/0119517 | A1* | 6/2006 | Futamata | H01Q 9/42 343/702 |

(Continued)

FOREIGN PATENT DOCUMENTS

| | | | |
|---|---|---|---|
| JP | H05-121139 | A | 5/1993 |
| JP | 2002-334964 | A | 11/2002 |

(Continued)

OTHER PUBLICATIONS

Taiwanese Office Action dated Dec. 8, 2021 in Taiwanese Application No. 110100375 with English translation.

*Primary Examiner* — Wei (Victor) Y Chan
(74) *Attorney, Agent, or Firm* — Collard & Roe, P.C.

(57) ABSTRACT

An antenna assembly comprises a circuit board formed with an antenna, a coaxial cable and a conductive film. The circuit board has an edge, a first pad and a second pad. An outer conductor of the coaxial cable has an exposed portion which is exposed from an outer cover of the coaxial cable over a predetermined area. The exposed portion is connected with the second pad. In a second direction perpendicular to a first direction, a center of the coaxial cable is positioned at a predetermined position. The conductive film is fixed on the circuit board. The conductive film has a main portion and at least one extending portion. In the predetermined area, the at least one extending portion and the second pad are aligned in the first direction. The at least one extending portion extends from the main portion over the predetermined position in the second direction.

12 Claims, 17 Drawing Sheets

(56) References Cited

U.S. PATENT DOCUMENTS

| | | | |
|---|---|---|---|
| 2012/0050119 | A1 | 3/2012 | Wang et al. |
| 2018/0083353 | A1 | 3/2018 | Tseng et al. |

FOREIGN PATENT DOCUMENTS

| | | | |
|---|---|---|---|
| JP | 2011-019178 | A | 1/2011 |
| TW | 201349663 | A | 12/2013 |
| WO | 2011/004649 | A1 | 1/2011 |

* cited by examiner

ANTENNA ASSEMBLY AND ELECTRONIC EQUIPMENT

CROSS REFERENCE TO RELATED APPLICATIONS

This application is based on and claims priority under 35 U.S.C. § 119 to Japanese Patent Application No. JP2020-041791 filed Mar. 11, 2019, the contents of which are incorporated herein in their entirety by reference.

BACKGROUND OF THE INVENTION

This invention relates to an antenna assembly comprising a conductive film.

Referring to FIG. 33, US 2012/0050119 A1 (Patent Document 1) discloses an antenna assembly 900 of this type. The antenna assembly 900 comprises a circuit board 910 formed with an antenna 920, a coaxial cable 930 and a conductive film 950. The circuit board 910 has an edge 912, a feed portion 914 and a ground portion 916. The coaxial cable 930 comprises a center conductor 934 and an outer conductor 936. The center conductor 934 is connected with the feed portion 914. The outer conductor 936 is connected with the ground portion 916. The conductive film 950 is connected with the ground portion 916. Since the antenna assembly 900 has the conductive film 950 which is connected with the ground portion 916, the antenna assembly 900 has a ground plane of increased size. Thus, the antenna assembly 900 provides improved antenna characteristics.

An antenna assembly such as the antenna assembly 900 of Patent Document 1 is required to facilitate operation of fixing a conductive film on a circuit board.

SUMMARY OF THE INVENTION

It is therefore an object of the present invention to provide an antenna assembly which facilitates operation of fixing a conductive film on a circuit board.

One aspect (first aspect) of the present invention provides an antenna assembly comprising a circuit board formed with an antenna, a coaxial cable and a conductive film. The circuit board has an edge, a first pad and a second pad. The coaxial cable comprises a center conductor, an insulator, an outer conductor and an outer cover. The center conductor is connected with the first pad. The outer conductor is insulated from the center conductor by the insulator. The outer conductor has an exposed portion which is exposed from the outer cover over a predetermined area. The exposed portion extends in a first direction. The exposed portion is connected with the second pad. In a second direction perpendicular to the first direction, a center of the coaxial cable is positioned at a predetermined position. The conductive film is fixed on the circuit board. The conductive film has a main portion and at least one extending portion. In the predetermined area, the at least one extending portion and the second pad are aligned in the first direction. The at least one extending portion extends from the main portion over the predetermined position in the second direction.

Another aspect (second aspect) of the present invention provides an electronic equipment comprising the antenna assembly of the first aspect and a ground member. The ground member is distinct and separated from the antenna assembly. The conductive film is connected with the ground member.

The antenna assembly of the present invention has the conductive film, the main portion and the at least one extending portion. Additionally, in the predetermined area, the at least one extending portion and the second pad are aligned in the first direction. Furthermore, the at least one extending portion extends from the main portion over the predetermined position in the second direction. Accordingly, the antenna assembly of the present invention is configured so that the conductive film has a portion of increased size which is temporarily placed on the circuit board when the conductive film is fixed on the circuit board. Thus, the antenna assembly of the present invention can facilitate operation of fixing the conductive film on the circuit board.

An appreciation of the objectives of the present invention and a more complete understanding of its structure may be had by studying the following description of the preferred embodiment and by referring to the accompanying drawings.

Figure 1:
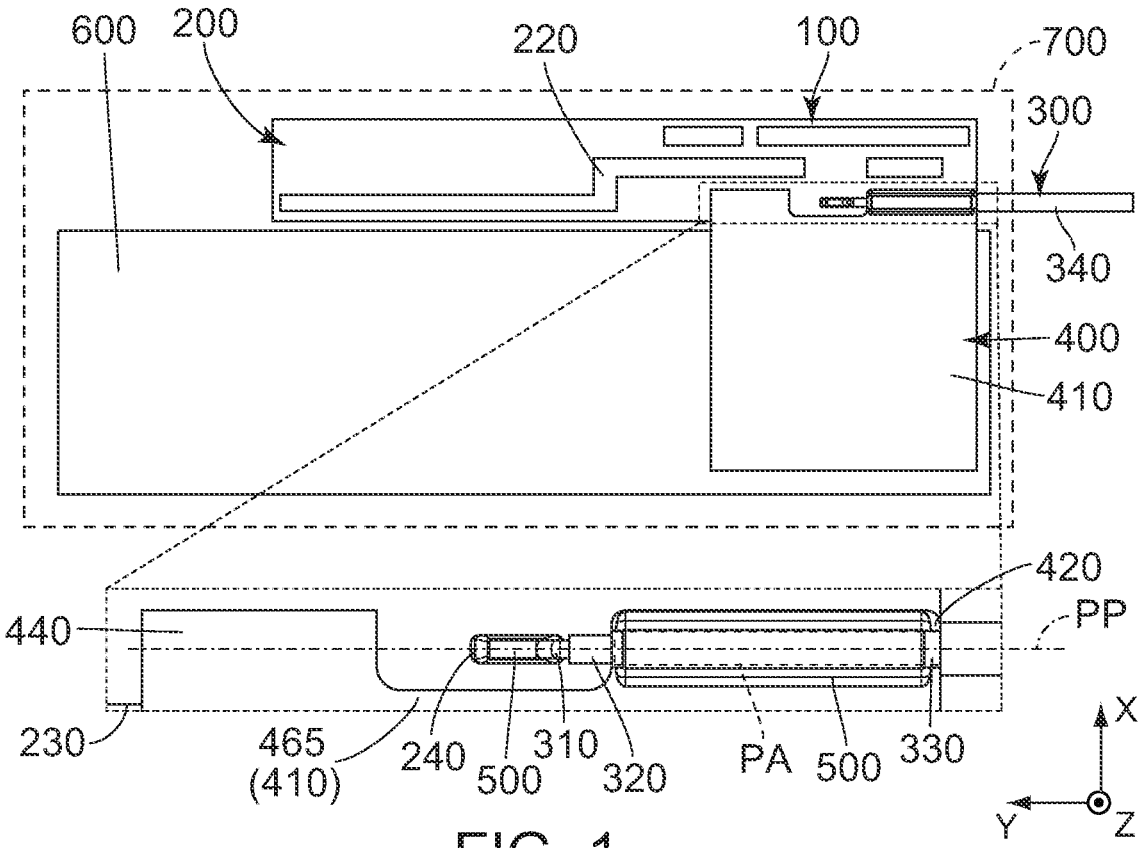
FIG. 1 is a top view showing an electronic equipment according to a first embodiment of the present invention. In the figure, a part of an antenna assembly is illustrated enlarged.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

As shown in FIG. 1, an electronic equipment 700 according to a first embodiment of the present invention comprises an antenna assembly 100 and a ground member 600. The ground member 600 is distinct and separated from the antenna assembly 100. The ground member 600 is, for example, a ground portion of a liquid crystal display panel or a housing made of metal.

Figure 2:
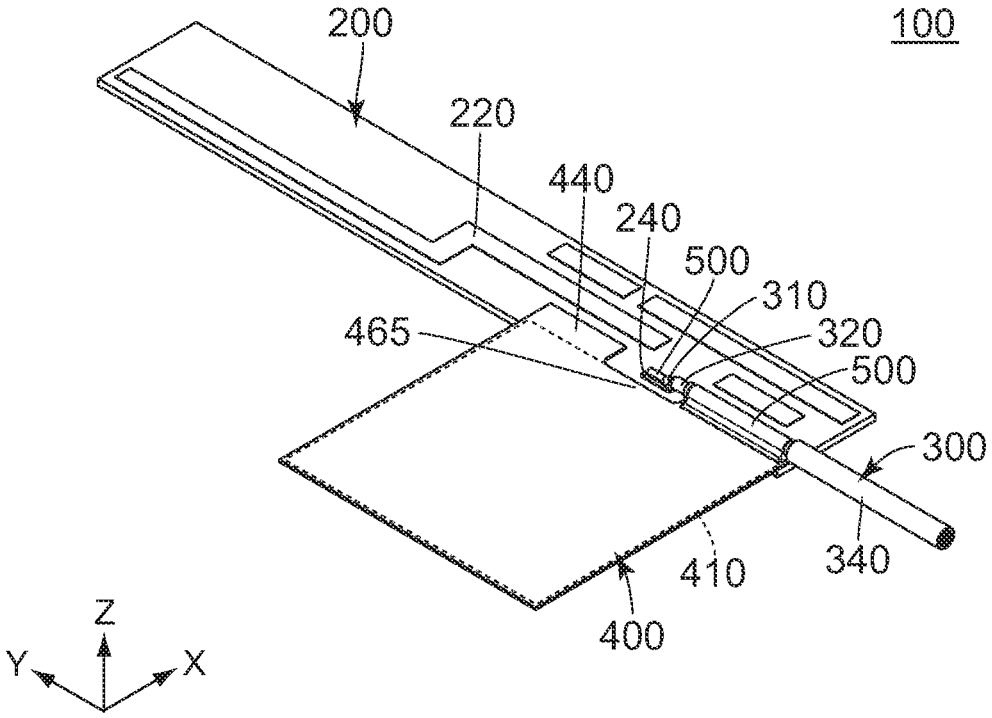
FIG. 2 is a perspective view showing the antenna assembly which is used for the electronic equipment of FIG. 1.

As shown in FIG. 2, the antenna assembly 100 according to the first embodiment of the present invention comprises a circuit board 200, a coaxial cable 300 and a conductive film 400. Specifically, the circuit board 200 is formed with an antenna 220.

Figure 10:
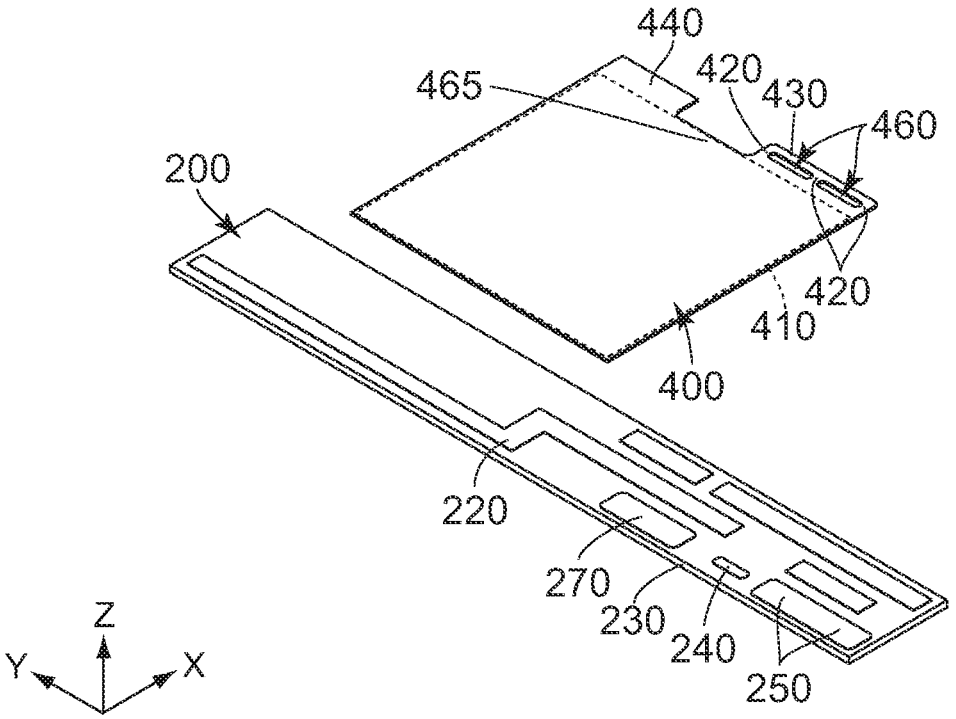
FIG. 10 is a perspective view showing the antenna assembly of FIG. 9. In the figure, the conductive film is not fixed on the circuit board.

Referring to FIG. 10, the circuit board 200 of the present embodiment has an upper surface, a ground layer (not shown) and vias (not shown). Specifically, the upper surface faces in an up-down direction. The ground layer is positioned below the upper surface in the up-down direction. The vias are connected with the ground layer. In the present embodiment, the up-down direction is a Z-direction. Specifically, upward is a positive Z-direction while downward is a negative Z-direction.

As shown in FIG. 10, the circuit board 200 has a first pad 240, a second pad 250 and an edge 230.

As shown in FIG. 10, the first pad 240 of the present embodiment is provided on the upper surface of the circuit board 200.

As shown in FIG. 10, the second pad 250 of the present embodiment is provided on the upper surface of the circuit board 200. The first pad 240 and the second pad 250 are aligned in a first direction perpendicular to the up-down direction. In the present embodiment, the first direction is a Y-direction. In addition, the first direction is also referred to as a right-left direction. Specifically, it is assumed that rightward is a positive Y-direction while leftward is a negative Y-direction. The second pad 250 is positioned leftward of the first pad 240 in the right-left direction. The second pad 250 is positioned around a left end of the circuit board 200 in the right-left direction.

As shown in FIG. 10, the edge 230 of the present embodiment defines an end of the circuit board 200 in a second direction perpendicular to both the up-down direction and the first direction. In the present embodiment, the second direction is an X-direction. In addition, the second direction is also referred to as a front-rear direction. Specifically, it is assumed that forward is a positive X-direction while rearward is a negative X-direction. The edge 230 defines a rear end of the circuit board 200 in the front-rear direction.

As shown in FIG. 10, the circuit board 200 further has a third pad 270.

As shown in FIG. 10, the third pad 270 of the present embodiment is provided on the upper surface of the circuit board 200. All of the first pad 240, the second pad 250 and the third pad 270 are positioned on the common surface of the circuit board 200. The third pad 270 is positioned rightward of the first pad 240 in the right-left direction. The first pad 240 is positioned between the second pad 250 and the third pad 270 in the first direction, or in the right-left direction. The third pad 270 is electrically connected with the second pad 250. More specifically, the second pad 250 is connected with the ground layer through the vias, and the third pad 270 is connected with the ground layer through the vias. Thus, the second pad 250 and the third pad 270 are electrically connected with each other through the vias and the ground layer.

As shown in FIG. 1, the coaxial cable 300 of the present embodiment extends in the first direction, or in the right-left direction. In the second direction perpendicular to the first direction, a center of the coaxial cable 300 is positioned at a predetermined position PP. In other words, in the front-rear direction, the center of the coaxial cable 300 is positioned at the predetermined position PP. The predetermined position PP is positioned forward of the edge 230 in the front-rear direction. Additionally, the predetermined position PP is positioned rearward of a front end of the conductive film 400 in the front-rear direction.

Figure 3:
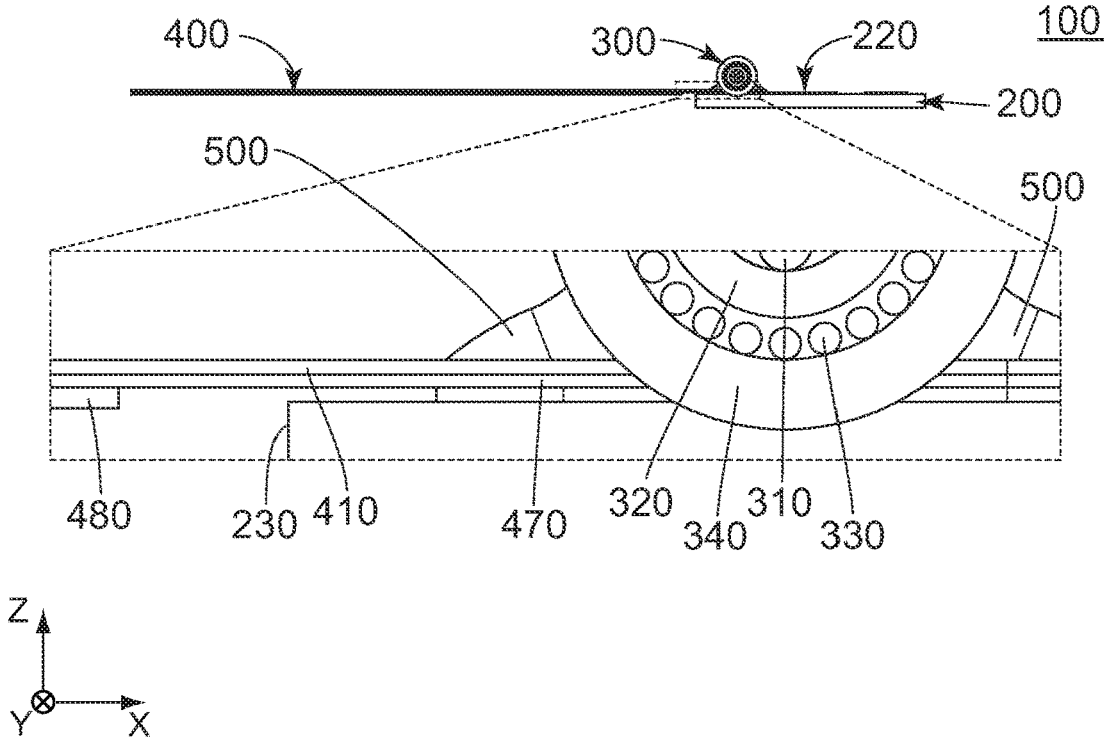
FIG. 3 is a side view showing the antenna assembly of FIG. 2. In the figure, a part of the antenna assembly is illustrated enlarged.
Figure 4:
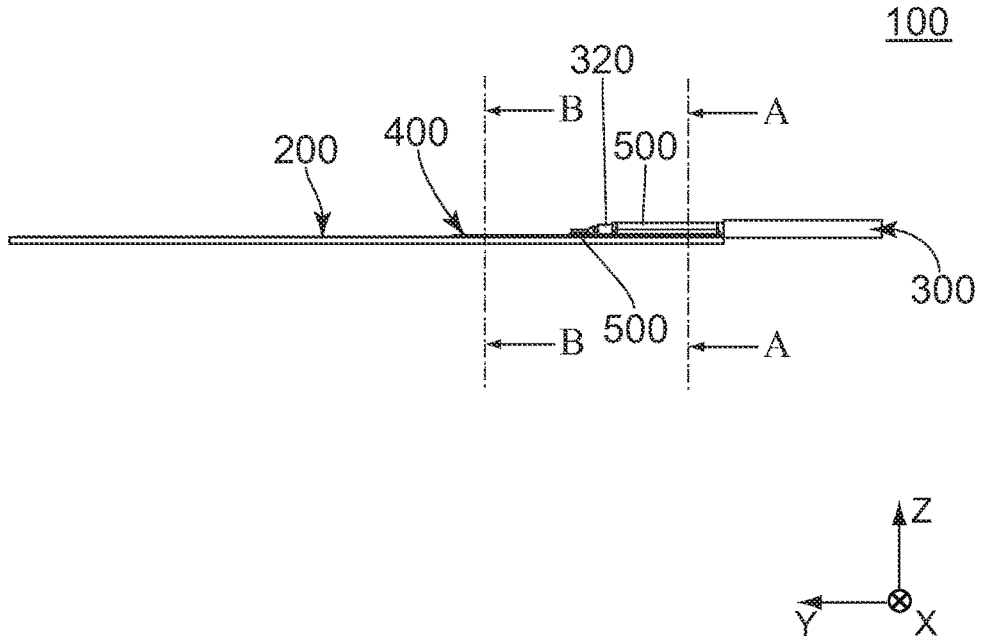
FIG. 4 is a rear view showing the antenna assembly of FIG. 2.

As shown in FIG. 3, the coaxial cable 300 comprises a center conductor 310, an insulator 320, an outer conductor 330 and an outer cover 340.

Figure 5:
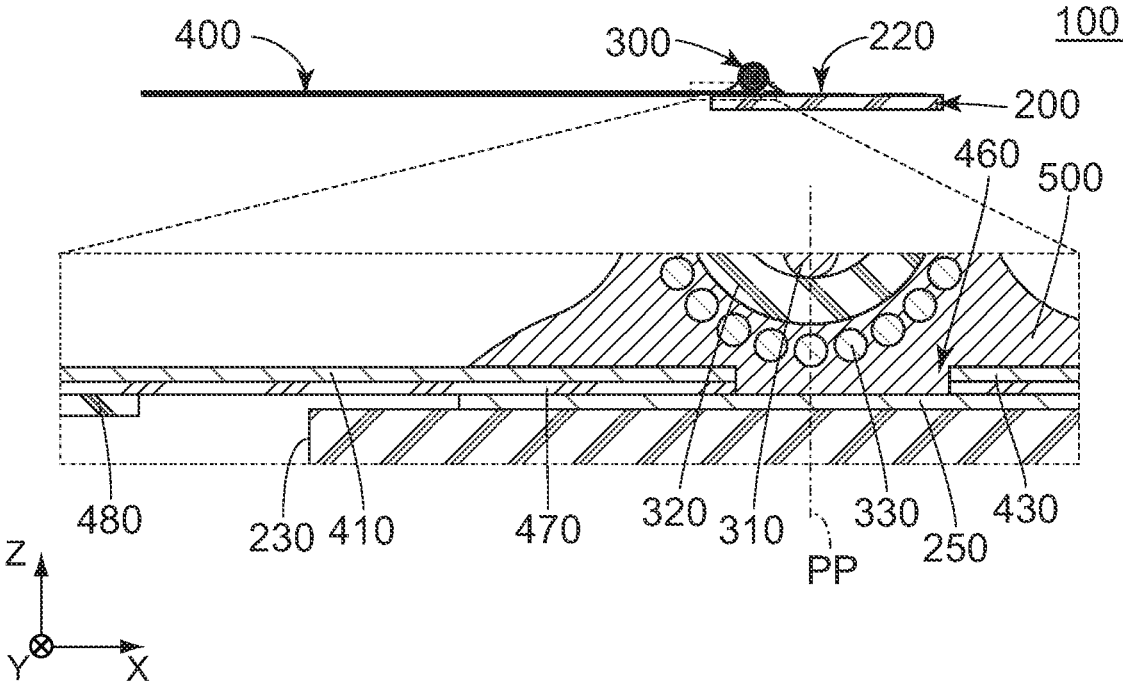
FIG. 5 is a cross-sectional view showing the antenna assembly of FIG. 4, taken along line A-A. In the figure, a part of the antenna assembly is illustrated enlarged.
Figure 8:
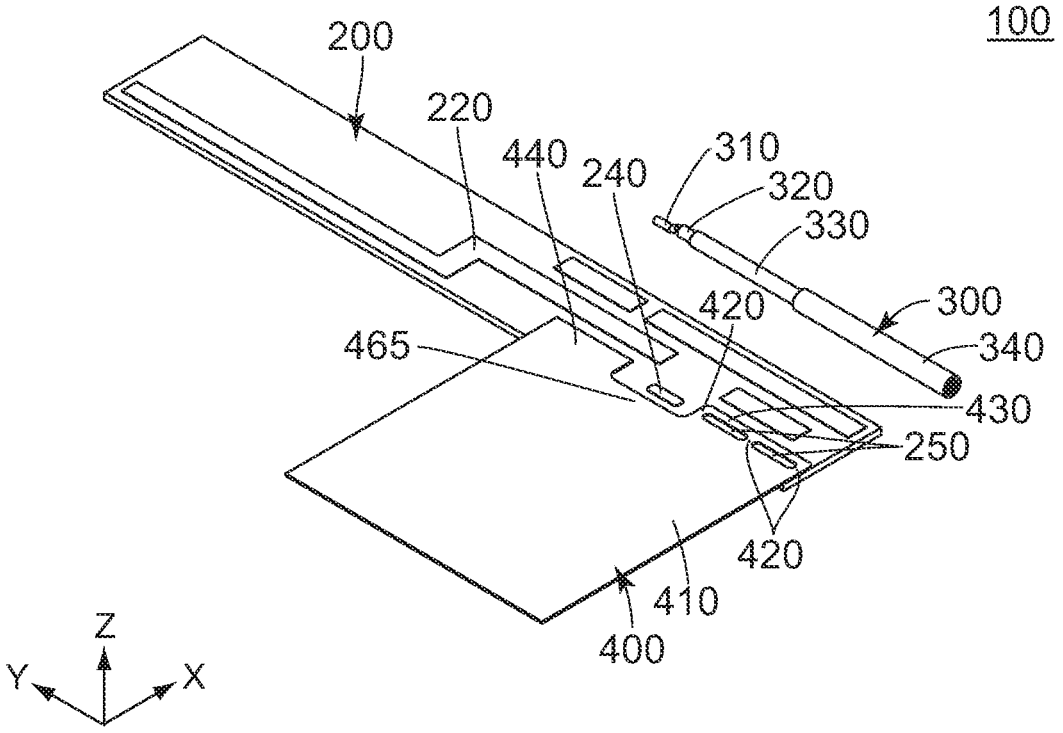
FIG. 8 is a perspective view showing the antenna assembly of FIG. 7. In the figure, the conductive film is fixed on the circuit board while the coaxial cable is not soldered to the circuit board.

Referring to FIG. 5, the center conductor 310 is made of metal. As shown in FIG. 8, the center conductor 310 extends in the first direction, or in the right-left direction. An exposed portion of the center conductor 310, which is exposed to the outside of the coaxial cable 300, defines a right end of the coaxial cable 300. As shown in FIG. 1, the center conductor 310 is connected with the first pad 240. Specifically, the center conductor 310 is soldered on the first pad 240. More specifically, the exposed portion of the center conductor 310 is bonded to the first pad 240 by solder 500.

Figure 7:
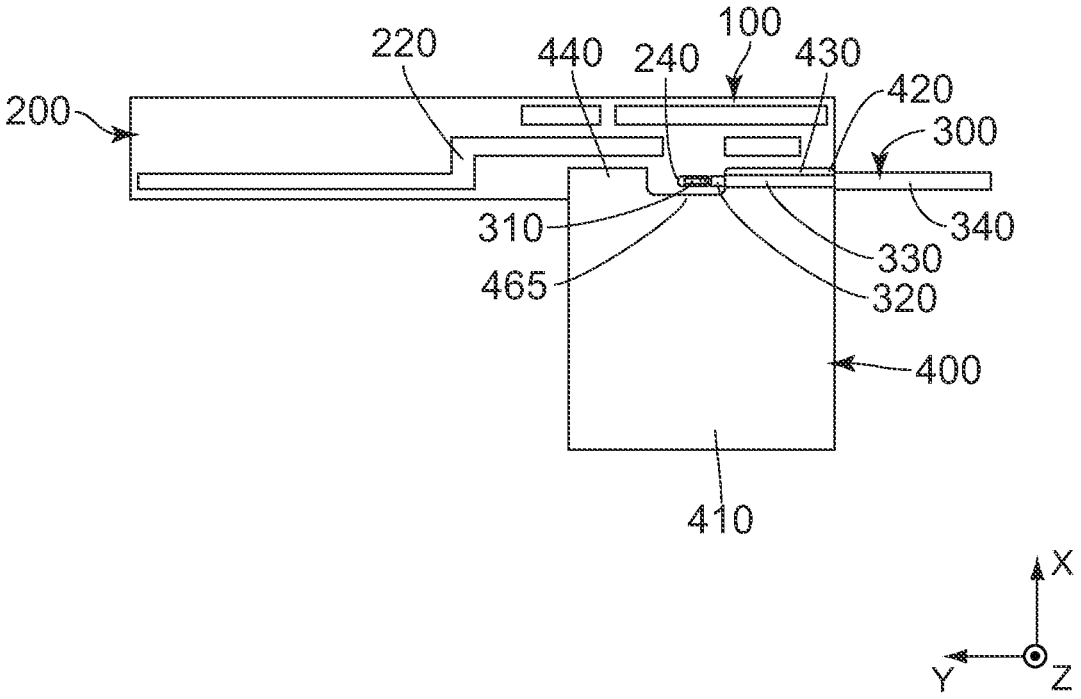
FIG. 7 is a top view for explaining an assembly method of the antenna assembly of FIG. 2. In the figure, a conductive film is fixed on a circuit board while a coaxial cable is not soldered to the circuit board.
Figure 9:
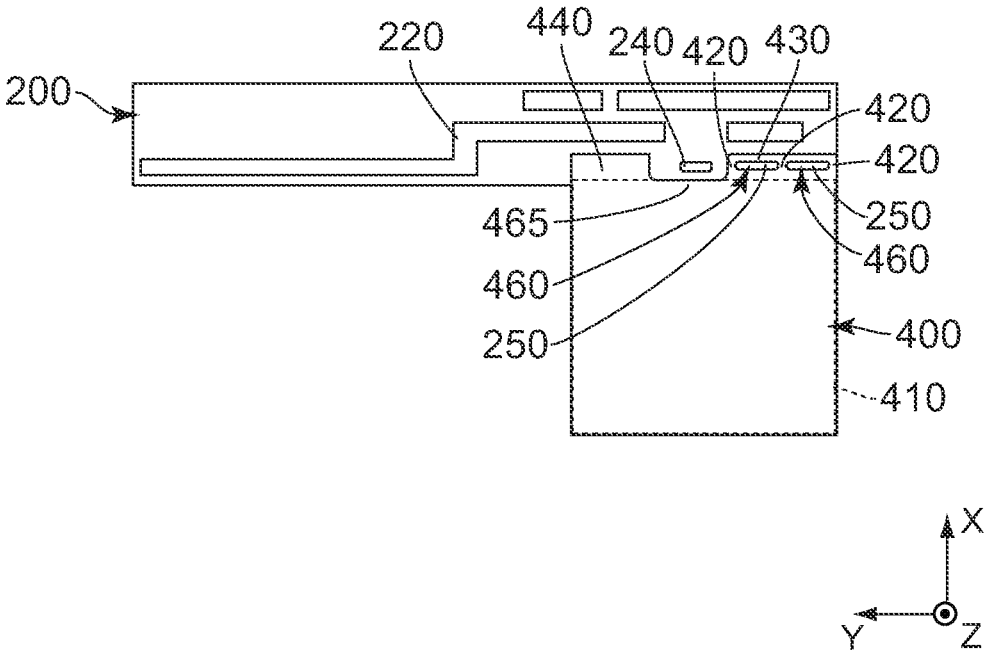
FIG. 9 is another top view for explaining the assembly method of the antenna assembly of FIG. 2. In the figure, the conductive film is not fixed on the circuit board.

Referring to FIG. 5, the insulator 320 of the present embodiment is made of resin. As shown in FIG. 8, the insulator 320 extends in the right-left direction, or in the first direction. An exposed portion of the insulator 320, which is exposed to the outside of the coaxial cable 300, is positioned leftward of the exposed portion of the center conductor 310 in the right-left direction. Referring to FIGS. 7 and 9, the exposed portion of the insulator 320 is positioned between the first pad 240 and the second pad 250 in the first direction, or in the right-left direction. Specifically, in the right-left direction, the exposed portion of the insulator 320 is positioned leftward of the first pad 240 and rightward of the second pad 250.

Referring to FIG. 5, the outer conductor 330 of the present embodiment is made of metal. As shown in FIG. 8, the outer conductor 330 extends in the first direction, or in the right-left direction. As understood from FIGS. 1, 3 and 7, the outer conductor 330 is insulated from the center conductor 310 by the insulator 320. The outer conductor 330 has an exposed portion which is exposed from the outer cover 340 over a predetermined area PA. As shown in FIG. 8, the exposed portion of the outer conductor 330 extends in the first direction, or in the right-left direction. The exposed portion of the outer conductor 330 is positioned leftward of the exposed portion of the insulator 320 in the right-left direction. As shown in FIG. 5, the exposed portion of the outer conductor 330 is connected with the second pad 250. The outer conductor 330 is soldered on the second pad 250. In other words, the outer conductor 330 is bonded to the second pad 250 by solder 500.

Referring to FIG. 7, the outer cover 340 of the present embodiment is made of resin. The outer cover 340 extends in the first direction, or in the right-left direction. The outer cover 340 defines an outer end of the coaxial cable 300 in a direction perpendicular to the first direction.

Referring to FIG. 1, the conductive film 400 of the present embodiment is a copper tape. However, the present invention is not limited thereto. The conductive film 400 may be made of conductive material other than a copper tape. The conductive film 400 is connected with the ground member 600. The conductive film 400 is fixed on the circuit board 200.

As shown in FIG. 10, the conductive film 400 has a main portion 410 and extending portions 420.

As shown in FIG. 10, the main portion 410 of the present embodiment has a flat-plate shape perpendicular to the up-down direction. As shown in FIG. 5, the main portion 410 is arranged to extend across the edge 230.

As shown in FIG. 1, the main portion 410 has a middle portion 465. The middle portion 465 is positioned around a middle of the main portion 410 in the first direction, or in the right-left direction. The middle portion 465 is positioned at a front end of the main portion 410 in the front-rear direction. The middle portion 465 is positioned rightward of the extending portions 420 in the right-left direction. The middle portion 465 is arranged to extend across the edge 230.

As shown in FIG. 10, the conductive film 400 of the present embodiment has the extending portions 420. More specifically, the number of the extending portions 420 is three. However, the present embodiment is not limited thereto. The number of the extending portions 420 may be three or more. The extending portions 420 are positioned away from each other in the first direction, or in the right-left direction. Referring to FIGS. 1 and 9, in the predetermined area PA, the extending portions 420 and the second pad 250 are aligned in the first direction, or in the right-left direction. Each of the extending portions 420 extends in the second direction from the main portion 410. Specifically, each of the extending portions 420 extends forward in the front-rear direction from the main portion 410. Each of the extending portions 420 extends from the main portion 410 over the predetermined position PP in the second direction. Specifically, each of the extending portions 420 extends forward from the main portion 410 over the predetermined position PP in the front-rear direction. Referring to FIGS. 5 and 9, the extending portion 420 is positioned between the outer conductor 330 and the circuit board 200 in the up-down direction, or in a direction perpendicular to both the first direction and the second direction. The second pad 250 and the outer conductor 330 are connected with each other between the extending portions 420. More specifically, the second pad 250 and the outer conductor 330 are connected with each other through the solder 500 between the extending portions 420. However, the present invention is not limited thereto. The second pad 250 and the outer conductor 330 should be connected with each other at least between the extending portions 420.

As shown in FIG. 9, the conductive film 400 further has a coupling portion 430. The coupling portion 430 extends in the first direction, or in the right-left direction. The coupling portion 430 couples the extending portions 420 with each other at a location which is away from the main portion 410 in the second direction. Specifically, the coupling portion 430 couples the extending portions 420 with each other at a location which is forwardly away from the main portion 410 in the front-rear direction. The coupling portion 430 couples all of the extending portions 420 with each other. As shown in FIG. 5, the coupling portion 430 is positioned forward of the predetermined position PP in the second direction, or in the front-rear direction. The coupling portion 430 is positioned between the outer conductor 330 and the circuit board 200 in the up-down direction, or in the direction perpendicular to both the first direction and the second direction.

As shown in FIG. 10, the main portion 410, the extending portions 420 and the coupling portion 430 form two holes 460. In other words, the conductive film 400 has the two holes 460. Each of the holes 460 pierces the conductive film 400 in the up-down direction. However, the present invention is not limited thereto. The conductive film 400 may have no hole 460. If the conductive film 400 has no hole 460, the number of the extending portion 420 should be one.

As shown in FIG. 5, an interior space of the hole 460 is filled with the solder 500.

As shown in FIG. 1, the conductive film 400 further has an auxiliary extending portion 440. The auxiliary extending portion 440 has a flat-plate shape perpendicular to the up-down direction. When the conductive film 400 is viewed along the up-down direction, the auxiliary extending portion 440 has a rectangular shape extending long in the first direction, or in the right-left direction. The auxiliary extending portion 440 has no hole piercing the conductive film 400 in the up-down direction. However, the present invention is not limited thereto. The auxiliary extending portion 440 may have any shape. The auxiliary extending portion 440 extends from the main portion 410 over the predetermined position PP in the second direction. Specifically, the auxiliary extending portion 440 extends forward from the main portion 410 over the predetermined position PP in the front-rear direction. As shown in FIG. 9, the middle portion 465 is positioned between the extending portion 420 and the auxiliary extending portion 440 in the first direction, or in the right-left direction. The middle portion 465 is positioned leftward of the auxiliary extending portion 440 in the right-left direction.

Since the conductive film 400 of the present embodiment has the auxiliary extending portion 440, grounding connection between the ground layer of the circuit board 200 and the conductive film 400 is enhanced. Thus, the antenna 220 can have further improved antenna characteristics.

Figure 6:
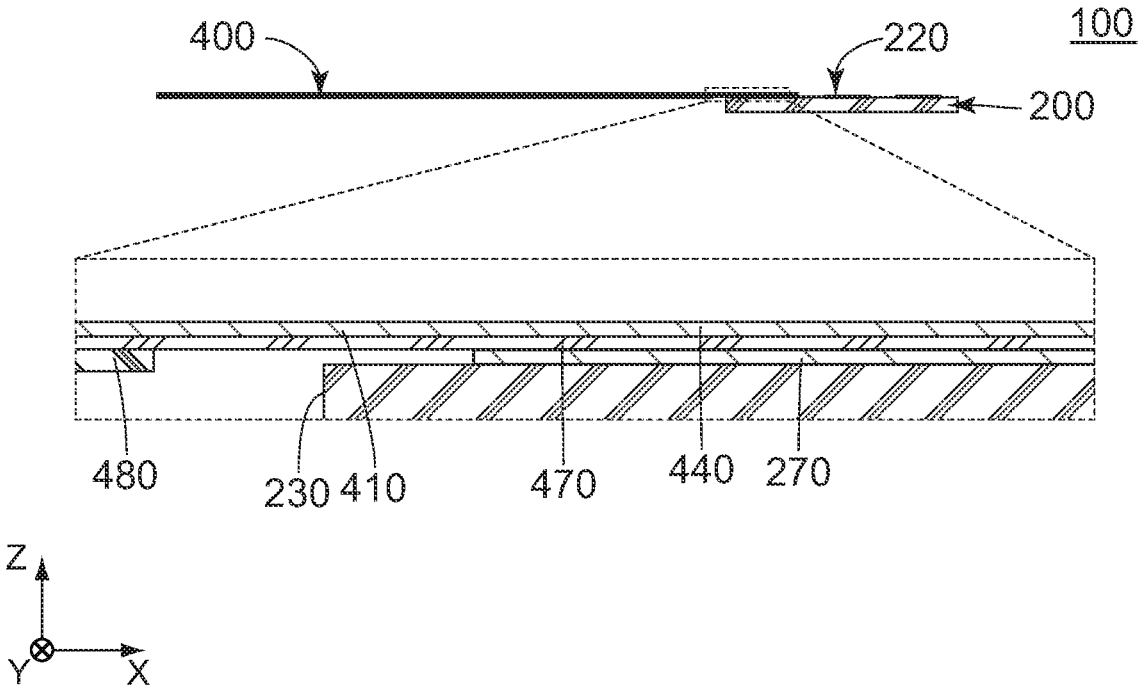
FIG. 6 is a cross-sectional view showing the antenna assembly of FIG. 4, taken along line B-B. In the figure, a part of the antenna assembly is illustrated enlarged.

As shown in FIGS. 5 and 6, the conductive film 400 further has an adhesive layer 470 and a release paper 480

As shown in FIGS. 5 and 6, the adhesive layer 470 of the present embodiment is provided on a lower surface of the conductive film 400. A front part of the adhesive layer 470 is adhered to the circuit board 200. In other words, the conductive film 400 is fixed on the circuit board 200 via the adhesive layer 470. More specifically, the conductive film 400 is fixed on the upper surface of the circuit board 200 via the adhesive layer 470. The front part of the adhesive layer 470, which is adhered to the circuit board 200, was covered with the release paper 480 before the conductive film 400 is attached to the circuit board 200. Accordingly, the front part of the adhesive layer 470 is adhered to the circuit board 200 as follows: the release paper 480 is removed from the adhesive layer 470 so that the front part of the adhesive layer 470 is exposed to the outside of the conductive film 400; and the exposed front part of the adhesive layer 470 is adhered to the circuit board 200.

As shown in FIG. 6, the auxiliary extending portion 440 and the third pad 270 are connected with each other through the adhesive layer 470. However, the present invention is not limited thereto. Specifically, the auxiliary extending portion 440 may be directly connected with the third pad 270 by means of ultrasonic welding or the like so that the adhesive layer 470 is not interposed between the auxiliary extending portion 440 and the third pad 270. Alternatively, the auxiliary extending portion 440 may be soldered to the third pad 270. In other words, the auxiliary extending portion 440 may be directly connected with the third pad 270 or may be indirectly connected with the third pad 270 through a conductive member such as solder 500.

As shown in FIGS. 5 and 6, the release paper 480 of the present embodiment covers a part of a lower surface of the adhesive layer 470. The conductive film 400 is connected with the ground member 600 as follows: the release paper 480 is removed from the adhesive layer 470 so that a part of the adhesive layer 470 is exposed to the outside of the conductive film 400; and the exposed part of the adhesive layer 470 is adhered to an upper surface of the ground member 600.

Hereinafter, a detailed description will be made about an example of an assembly method of the antenna assembly 100.

First, referring to FIGS. 5, 6, 8 and 10, the release paper 480 covering a front part of the adhesive layer 470 is removed from the adhesive layer 470. Then, the front part of the adhesive layer 470 is exposed to the outside of the conductive film 400. Next, the conductive film 400 is attached to the upper surface of the circuit board 200 via the exposed front part of the adhesive layer 470 so that the main portion 410 is arranged to extend across the edge 230 of the circuit board 200. Thus, the circuit board 200 and the conductive film 400 result in a state shown in FIG. 8.

After that, the coaxial cable 300 is temporarily placed on the conductive film 400, which is attached to the circuit board 200, so that the center conductor 310 is placed on the first pad 240 while the outer conductor 330 is placed on the second pad 250. Meanwhile, in the predetermined area PA as shown in FIG. 1, the extending portions 420 and the second pad 250 are aligned in the first direction, or in the right-left direction. Also meanwhile, each of the extending portions 420 extends from the main portion 410 over the predetermined position PP as shown in FIG. 1 in the second direction, or in the front-rear direction. Thereafter, the center conductor 310 and the first pad 240 are bonded to each other by the solder 500, and the outer conductor 330 and the second pad 250 are bonded to each other by the solder 500. Thus, the conductive film 400 is fixed on the circuit board 200 so that the assembling of the antenna assembly 100 is completed.

Especially, in the aforementioned assembly process, the conductive film 400 is attached to the circuit board 200 so that the extending portions 420 and the second pad 250 are aligned in the first direction in the predetermined area PA while each of the extending portions 420 extends from the main portion 410 over the predetermined position PP in the second direction. Accordingly, the conductive film 400 has a portion of increased size which is attached to the circuit board 200 when the conductive film 400 is fixed on the circuit board 200. Thus, the antenna assembly 100 of the present embodiment can facilitate operation of fixing the conductive film 400 on the circuit board 200.

Second Embodiment

Figure 11:
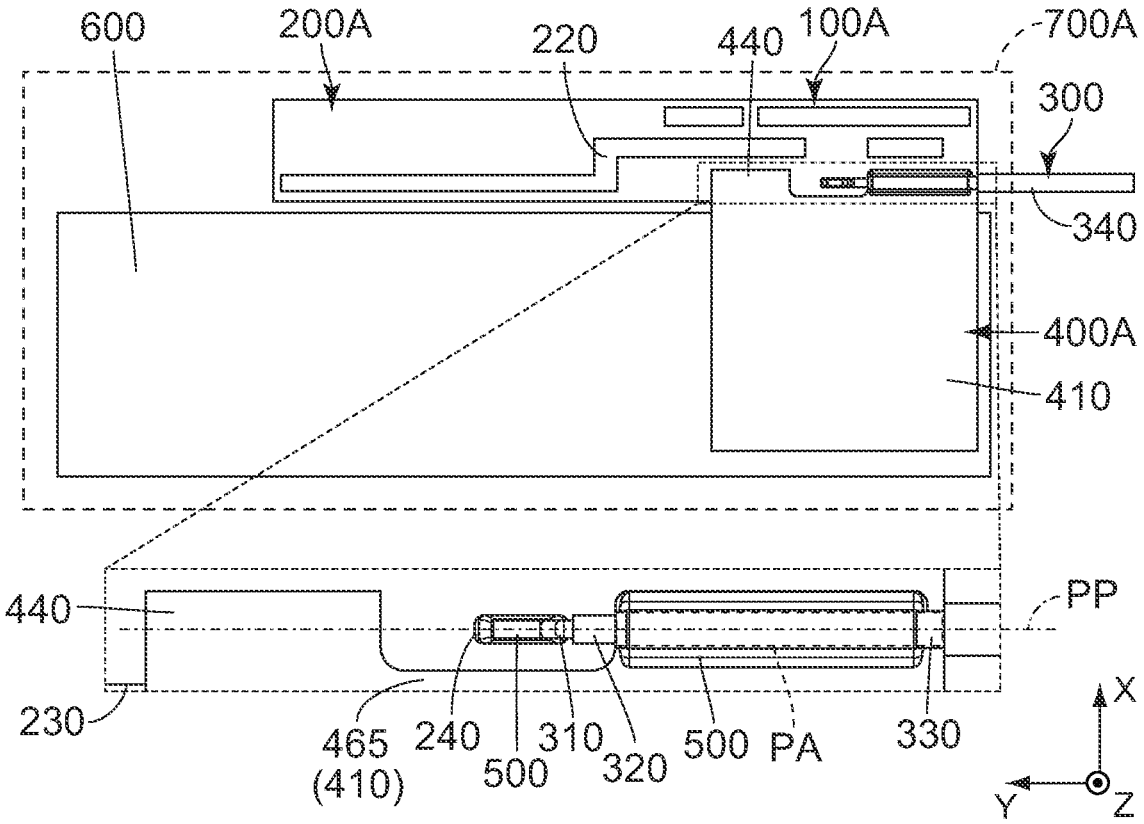
FIG. 11 is a top view showing an electronic equipment according to a second embodiment of the present invention. In the figure, a part of an antenna assembly is illustrated enlarged.
Figure 12:
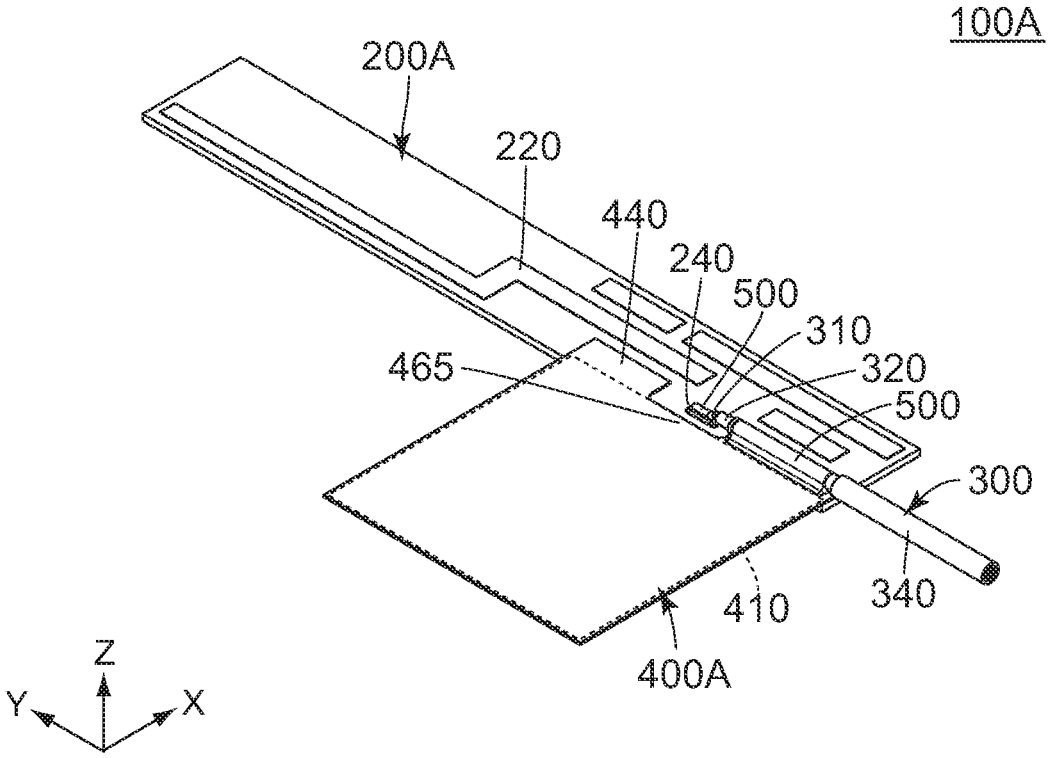
FIG. 12 is a perspective view showing the antenna assembly which is used for the electronic equipment of FIG. 11.
Figure 13:
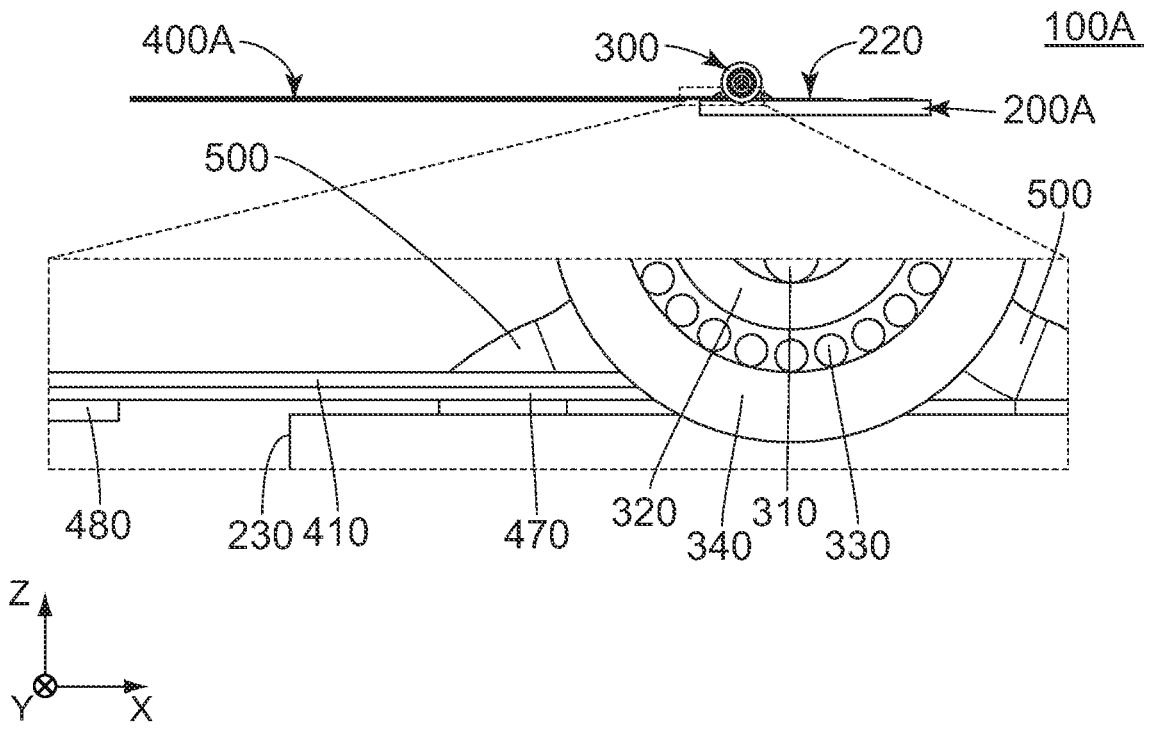
FIG. 13 is a side view showing the antenna assembly of FIG. 12. In the figure, a part of the antenna assembly is illustrated enlarged.
Figure 14:
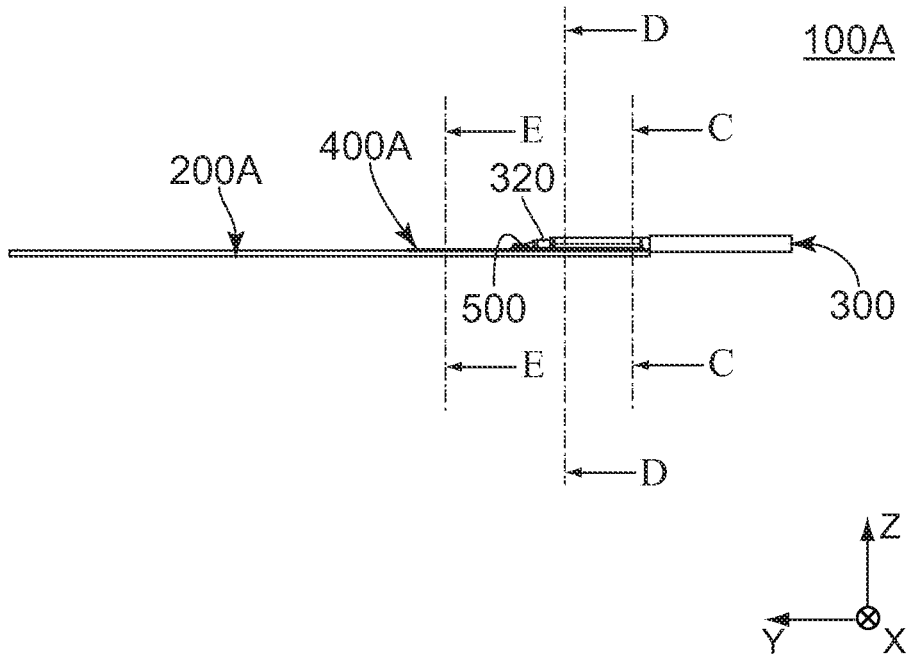
FIG. 14 is a rear view showing the antenna assembly of FIG. 12.

As shown in FIG. 11, an electronic equipment 700A according to a second embodiment of the present invention comprises an antenna assembly 100A and a ground member 600. Similar to the ground member 600 of the first embodiment, the ground member 600 of the present embodiment is distinct and separated from the antenna assembly 100A.

As shown in FIG. 11, the antenna assembly 100A according to the second embodiment of the present invention has a structure similar to that of the antenna assembly 100 of the aforementioned first embodiment as shown in FIG. 1. Components of the antenna assembly 100A shown in FIGS. 11 to 21 which are same as those of the antenna assembly 100 of the first embodiment are referred by using reference signs same as those of the antenna assembly 100 of the first embodiment. As for directions and orientations in the present embodiment, expressions same as those of the first embodiment will be used hereinbelow.

As shown in FIG. 11, the antenna assembly 100A of the present embodiment comprises a circuit board 200A, a coaxial cable 300 and a conductive film 400A. Specifically, the circuit board 200A is formed with an antenna 220. The coaxial cable 300 of the present embodiment has a structure same as that of the coaxial cable 300 of the first embodiment. Accordingly, a detailed explanation thereabout is omitted.

Figure 21:
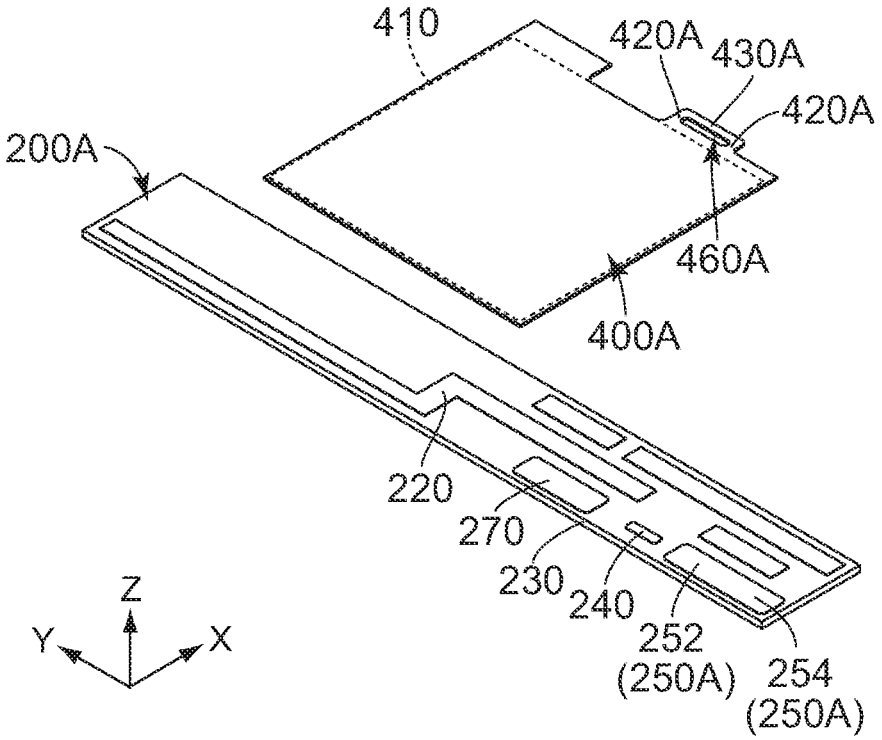
FIG. 21 is a perspective view showing the antenna assembly of FIG. 20. In the figure, the conductive film is not fixed on the circuit board.

As shown in FIG. 21, the circuit board 200A has a first pad 240, a second pad 250 and an edge 230. The first pad 240 and the edge 230 of the present embodiment have structures same as those of the first pad 240 and the edge 230 of the first embodiment. Accordingly, a detailed explanation thereabout is omitted.

As shown in FIG. 21, the second pad 250A of the present embodiment is provided on an upper surface of the circuit board 200A. The first pad 240 and the second pad 250A are aligned in the first direction perpendicular to the up-down direction. The second pad 250A is positioned leftward of the first pad 240 in the right-left direction. The second pad 250A is positioned around a left end of the circuit board 200A in the right-left direction. The second pad 250A is provided with a first portion 252 and a second portion 254.

Figure 16:
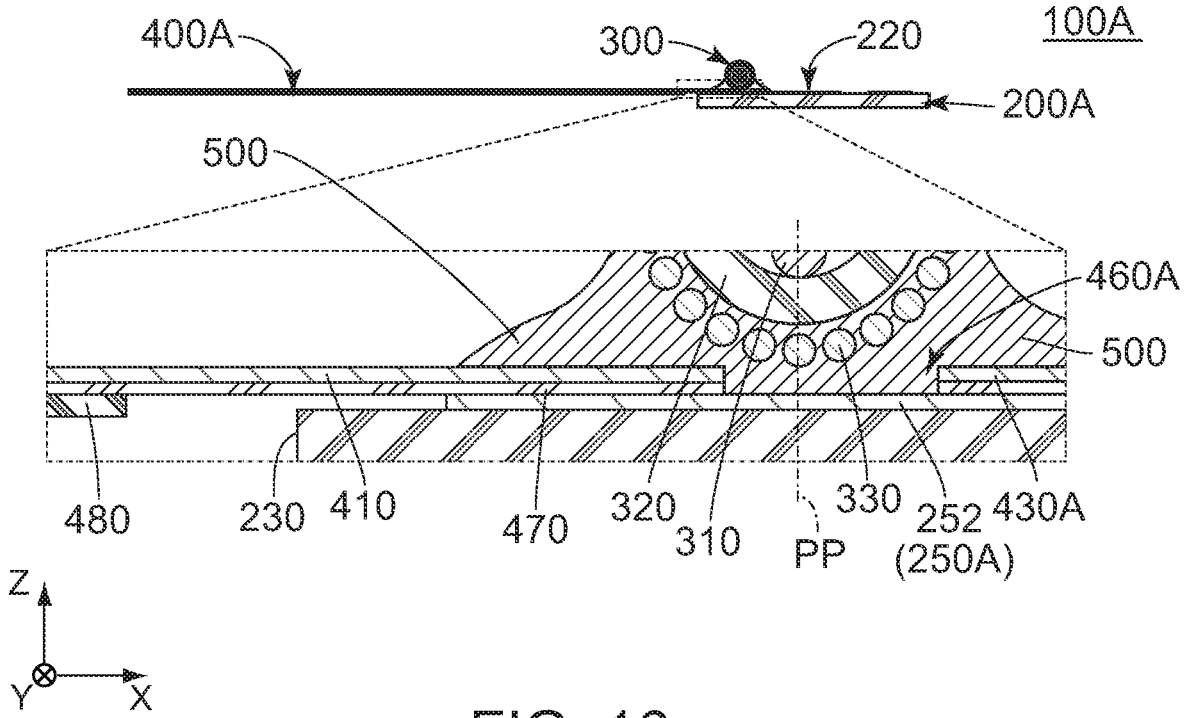
FIG. 16 is a cross-sectional view showing the antenna assembly of FIG. 14, taken along line D-D. In the figure, a part of the antenna assembly is illustrated enlarged.
Figure 17:
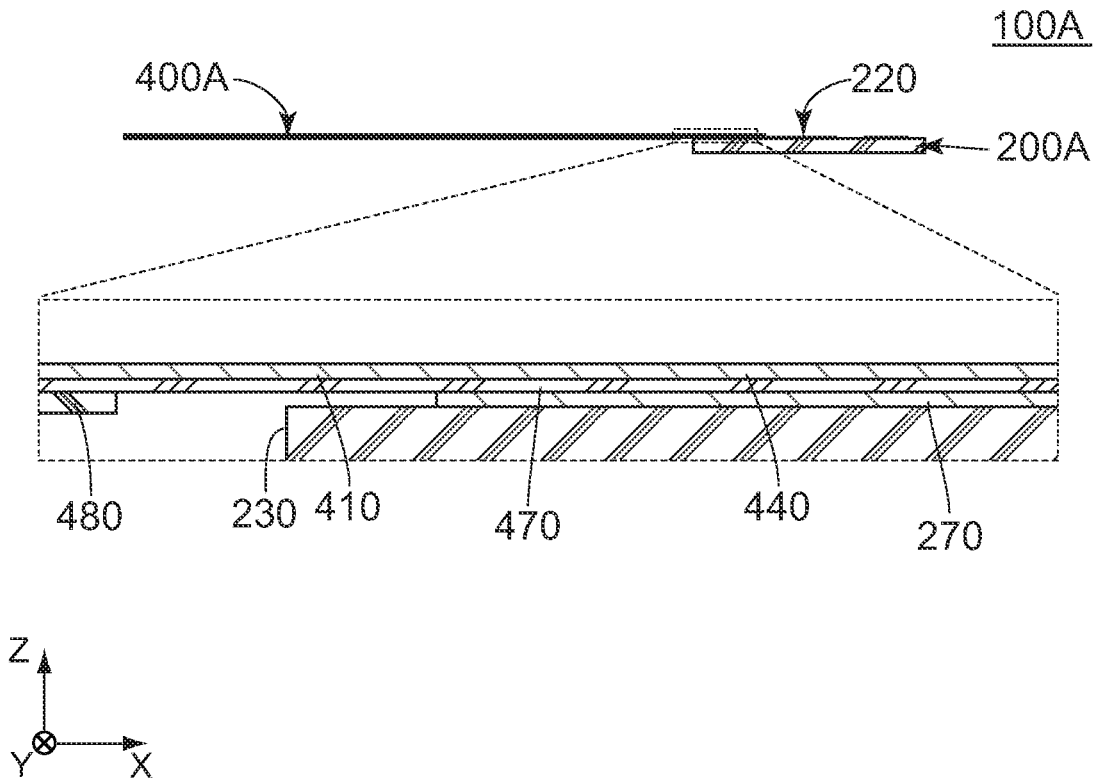
FIG. 17 is a cross-sectional view showing the antenna assembly of FIG. 14, taken along line E-E. In the figure, a part of the antenna assembly is illustrated enlarged.
Figure 18:
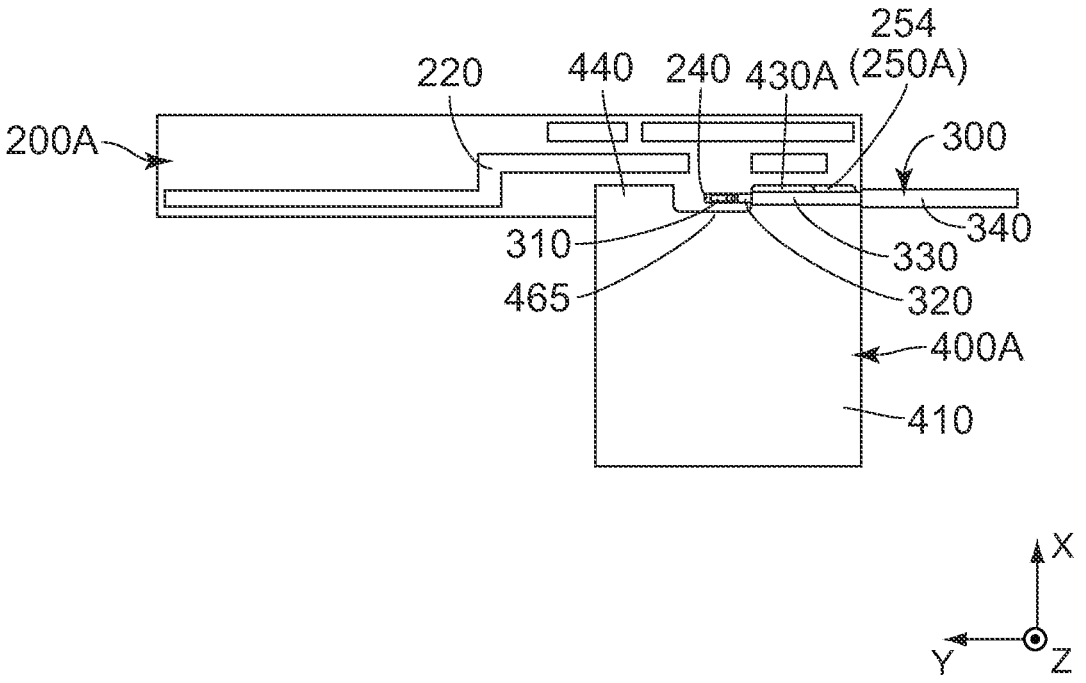
FIG. 18 is a top view for explaining an assembly method of the antenna assembly of FIG. 12. In the figure, a conductive film is fixed on a circuit board while a coaxial cable is not soldered to the circuit board.
Figure 19:
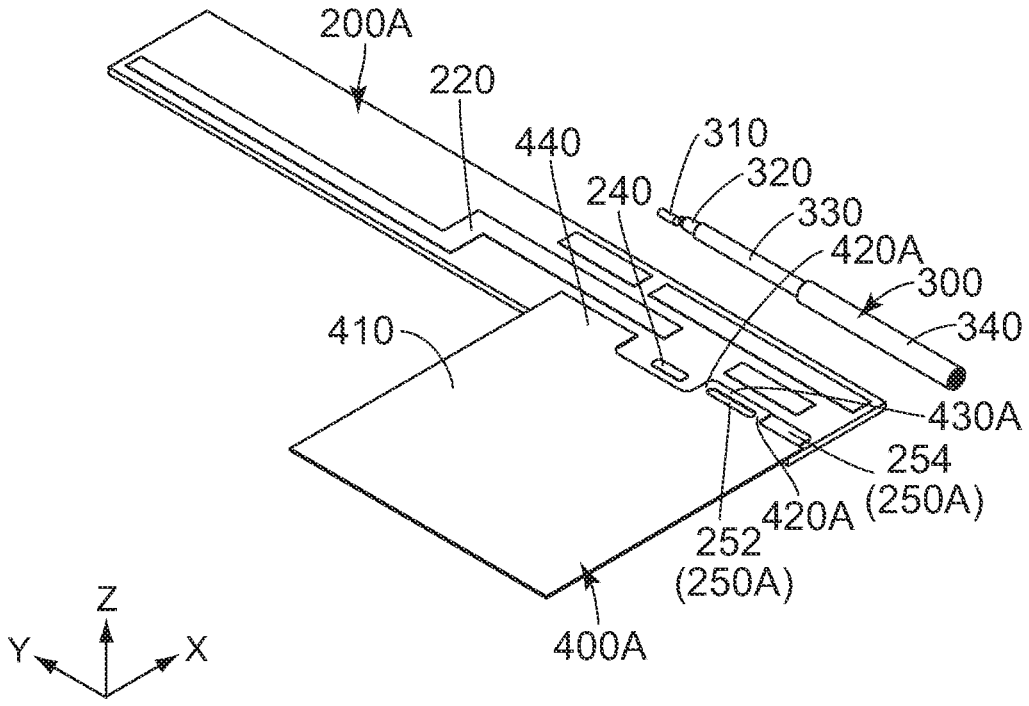
FIG. 19 is a perspective view showing the antenna assembly of FIG. 18. In the figure, the conductive film is fixed on the circuit board while the coaxial cable is not soldered to the circuit board.
Figure 20:
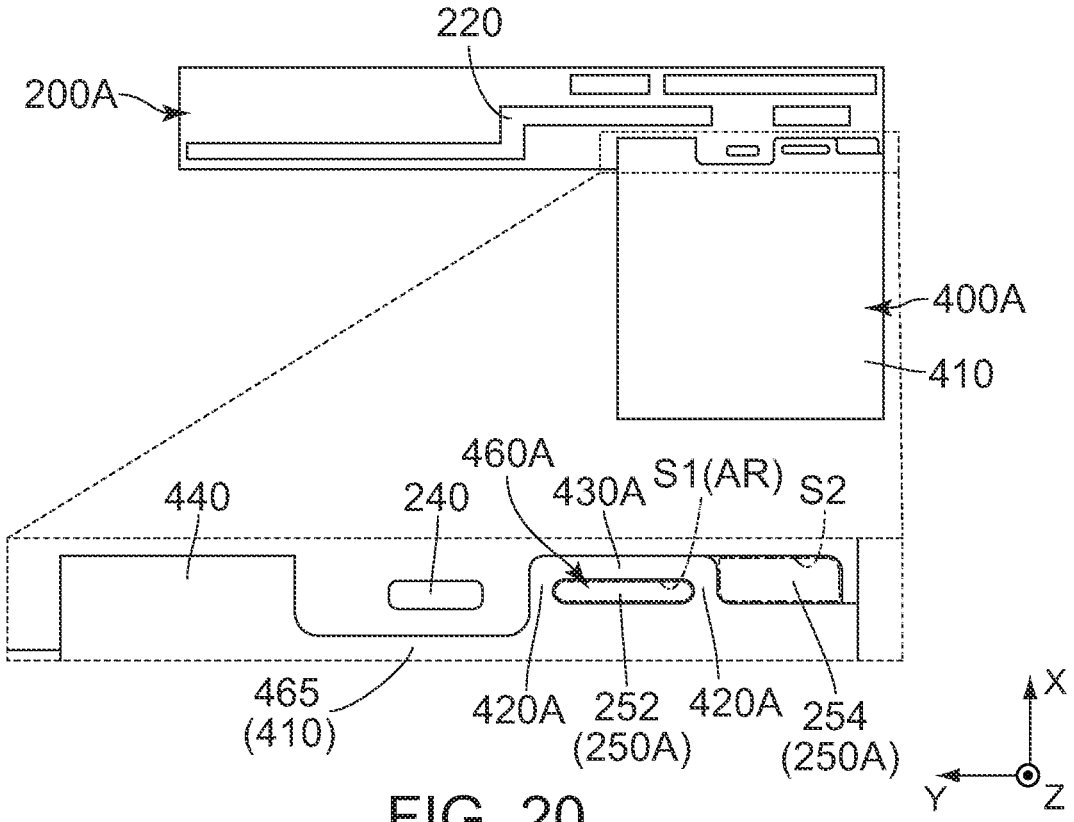
FIG. 20 is another top view for explaining the assembly method of the antenna assembly of FIG. 12. In the figure, the conductive film is not fixed on the circuit board, and parts of the circuit board and the conductive film are illustrated enlarged.

As shown in FIG. 20, the first portion 252 is a part of an upper surface of the second pad 250A. The first portion 252 is positioned between the first pad 240 and the second portion 254 in the first direction, or in the right-left direction. As shown in FIG. 16, an outer conductor 330 is connected with the first portion 252. The outer conductor 330 is soldered on the first portion 252. In other words, the outer conductor 330 is bonded to the first portion 252 by solder 500.

Figure 15:
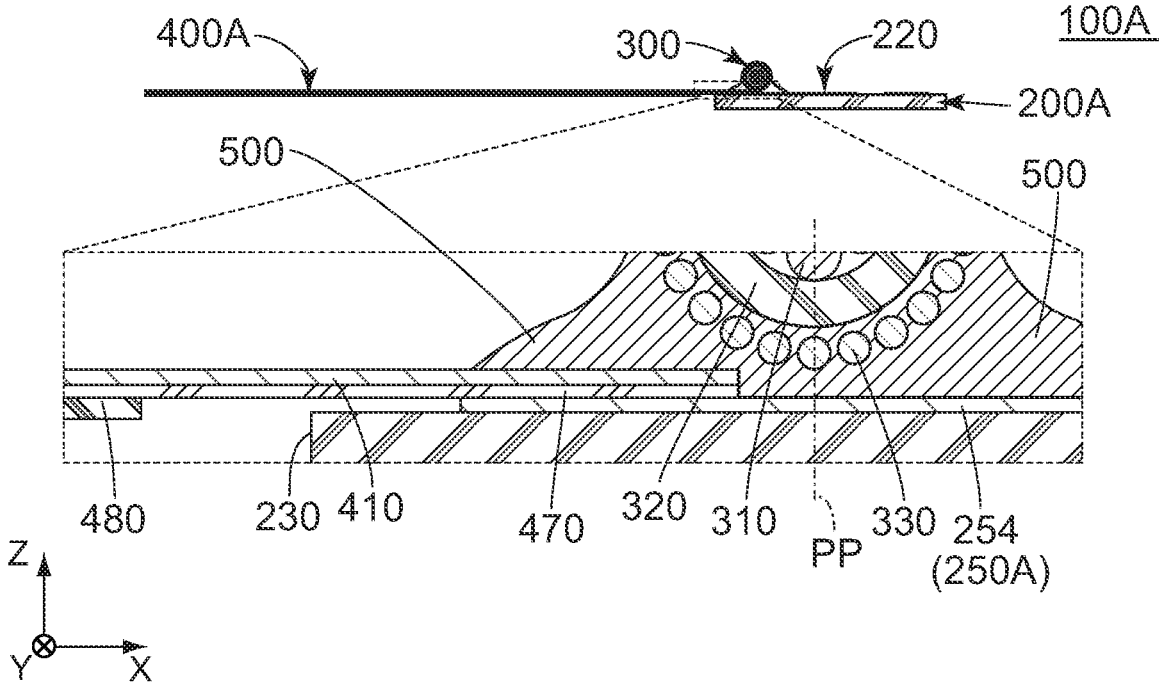
FIG. 15 is a cross-sectional view showing the antenna assembly of FIG. 14, taken along line C-C. In the figure, a part of the antenna assembly is illustrated enlarged.

As shown in FIG. 20, the second portion 254 of the present embodiment is a part of the upper surface of the second pad 250A. In other words, the first portion 252 and the second portion 254 are parts of the common upper surface of the second pad 250A. The second portion 254 is positioned leftward of the first portion 252 in the right-left direction. The second portion 254 is positioned around a left end or the circuit board 200A in the right-left direction. As shown in FIG. 15, the outer conductor 330 is connected with the second portion 254. The outer conductor 330 is soldered on the second portion 254. In other words, the outer conductor 330 is bonded to the second portion 254 by solder 500. More specifically, a base of the outer conductor 330 is bonded to the second portion 254 by the solder 500. Since the outer conductor 330 is connected with the first portion 252 as described above, the outer conductor 330 is connected with both of the first portion 252 and the second portion 254.

As described above, the base of the outer conductor 330 is bonded to the second portion 254 by the solder 500. This enables the outer conductor 330 to be rigidly held by the second pad 250A. Thus, the outer conductor 330 is hardly removed from the second pad 250A even if the coaxial cable 300 soldered on the circuit board 200A is swung.

Referring to FIG. 11, the conductive film 400A of the present embodiment is a copper tape. However, the present invention is not limited thereto. The conductive film 400A may be made of conductive material other than a copper tape. The conductive film 400A is connected with the ground member 600. The conductive film 400A is fixed on the circuit board 200A.

As shown in FIG. 21, the conductive film 400A has a main portion 410 and extending portions 420A. The main portion 410 of the present embodiment has a structure same as that of the main portion 410 of the first embodiment. Accordingly, a detailed explanation thereabout is omitted.

As shown in FIG. 20, the conductive film 400A of the present embodiment has the extending portions 420A. More specifically, the number of the extending portions 420A is two. The extending portions 420A are positioned away from each other in the first direction, or in the right-left direction. Each of the extending portions 420A extends in the second direction from the main portion 410. Specifically, each of the extending portions 420A extends forward in the front-rear direction from the main portion 410. Each of the extending portions 420A is positioned rightward of the second portion 254 in the right-left direction. Referring to FIGS. 11 and 20, in a predetermined area PA, the extending portions 420A and the second pad 250A are aligned in the first direction, or in the right-left direction. Each of the extending portions 420A extends from the main portion 410 over a predetermined position PP in the second direction. Specifically, each of the extending portions 420A extends forward from the main portion 410 over the predetermined position PP in the front-rear direction. Referring to FIGS. 16 and 20, the extending portion 420A is positioned between the outer conductor 330 and the circuit board 200A in the up-down direction, or in a direction perpendicular to both the first direction and the second direction. The second pad 250A and the outer conductor 330 are connected with each other between the extending portions 420A. More specifically, the second pad 250A and the outer conductor 330 are connected with each other through the solder 500 between the extending portions 420A. However, the present invention is not limited thereto. The second pad 250A and the outer conductor 330 should be connected with each other at least between the extending portions 420A.

As shown in FIG. 20, the conductive film 400A further has a coupling portion 430A. The coupling portion 430A extends in the first direction, or in the right-left direction. The coupling portion 430A couples the extending portions 420A with each other at a location which is away from the main portion 410 in the second direction. Specifically, the coupling portion 430A couples the extending portions 420A with each other at a location which is forwardly away from the main portion 410 in the front-rear direction. The first portion 252 is positioned in a region AR which is surrounded by the extending portions 420A and the coupling portion 430A. The coupling portion 430A is positioned rightward of the second portion 254 in the right-left direction. As shown in FIG. 16, the coupling portion 430A is positioned forward of the predetermined position PP in the second direction, or in the front-rear direction. The coupling portion 430A is positioned between the outer conductor 330 and the circuit board 200A in the up-down direction, or in the direction perpendicular to both the first direction and the second direction.

As shown in FIG. 20, the main portion 410, the extending portions 420A and the coupling portion 430A form a single hole 460A. In other words, the conductive film 400A has the single hole 460A. The hole 460A pierces the conductive film 400A in the up-down direction. However, the present invention is not limited thereto. The conductive film 400A may have no hole 460A. If the conductive film 400A has no hole 460A, the number of the extending portion 420A should be one.

As shown in FIG. 16, an interior space of the hole 460A is filled with solder 500.

Hereinafter, a detailed description will be made about an example of an assembly method of the antenna assembly 100A.

First, referring to FIGS. 15, 16, 17, 19 and 21, a release paper 480 covering a front part of an adhesive layer 470 is removed from the adhesive layer 470. Then, the front part of the adhesive layer 470 is exposed to the outside of the conductive film 400A. Next, the conductive film 400A is attached to the upper surface of the circuit board 200A via the exposed front part of the adhesive layer 470 so that the main portion 410 is arranged to extend across the edge 230 of the circuit board 200A. Thus, the circuit board 200A and the conductive film 400A result in a state shown in FIG. 19.

After that, the coaxial cable 300 is temporarily placed on the conductive film 400A, which is attached to the circuit board 200A, so that a center conductor 310 is placed on the first pad 240 while the outer conductor 330 is placed on the second pad 250A. Meanwhile, in the predetermined area PA as shown in FIG. 11, the extending portions 420A and the second pad 250A are aligned in the first direction, or in the right-left direction. Also meanwhile, each of the extending portions 420A extends from the main portion 410 over the predetermined position PP as shown in FIG. 11 in the second direction, or in the front-rear direction. Thereafter, the center conductor 310 and the first pad 240 are bonded to each other by the solder 500, and the outer conductor 330 and the second pad 250A are bonded to each other by the solder 500. Thus, the conductive film 400A is fixed on the circuit board 200A so that the assembling of the antenna assembly 100A is completed.

Especially, in the aforementioned assembly process, the conductive film 400A is attached to the circuit board 200A so that the extending portions 420A and the second pad 250A are aligned in the first direction in the predetermined area PA while each of the extending portions 420A extends from the main portion 410 over the predetermined position PP in the second direction. Accordingly, the conductive film 400A has a portion of increased size which is attached to the circuit board 200A when the conductive film 400A is fixed on the circuit board 200A. Thus, the antenna assembly 100A of the present embodiment can facilitate operation of fixing the conductive film 400A on the circuit board 200A.

Third Embodiment

Figure 22:
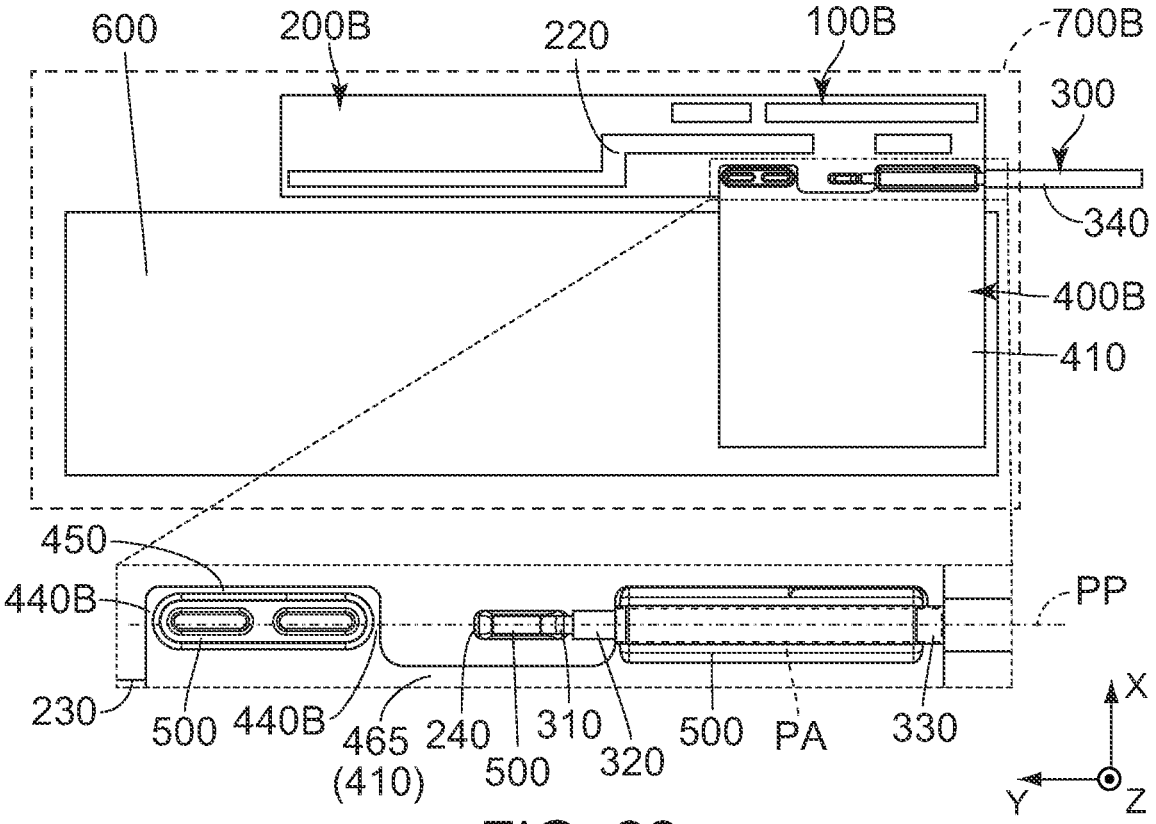
FIG. 22 is a top view showing an electronic equipment according to a third embodiment of the present invention. In the figure, a part of an antenna assembly is illustrated enlarged.
Figure 23:
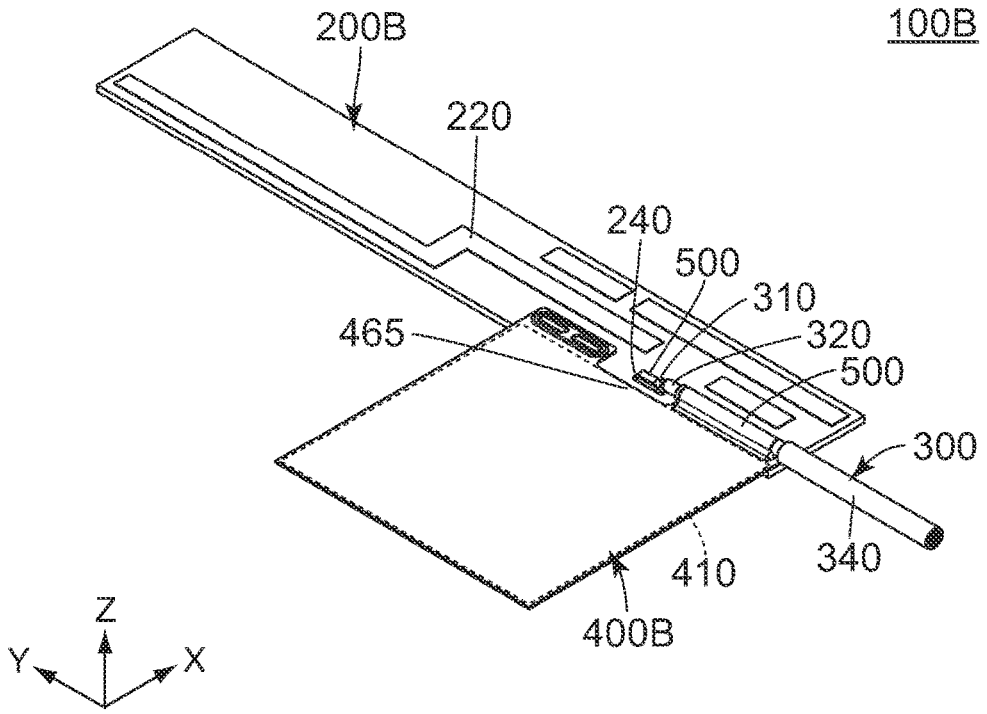
FIG. 23 is a perspective view showing the antenna assembly which is used for the electronic equipment of FIG. 22.
Figure 24:
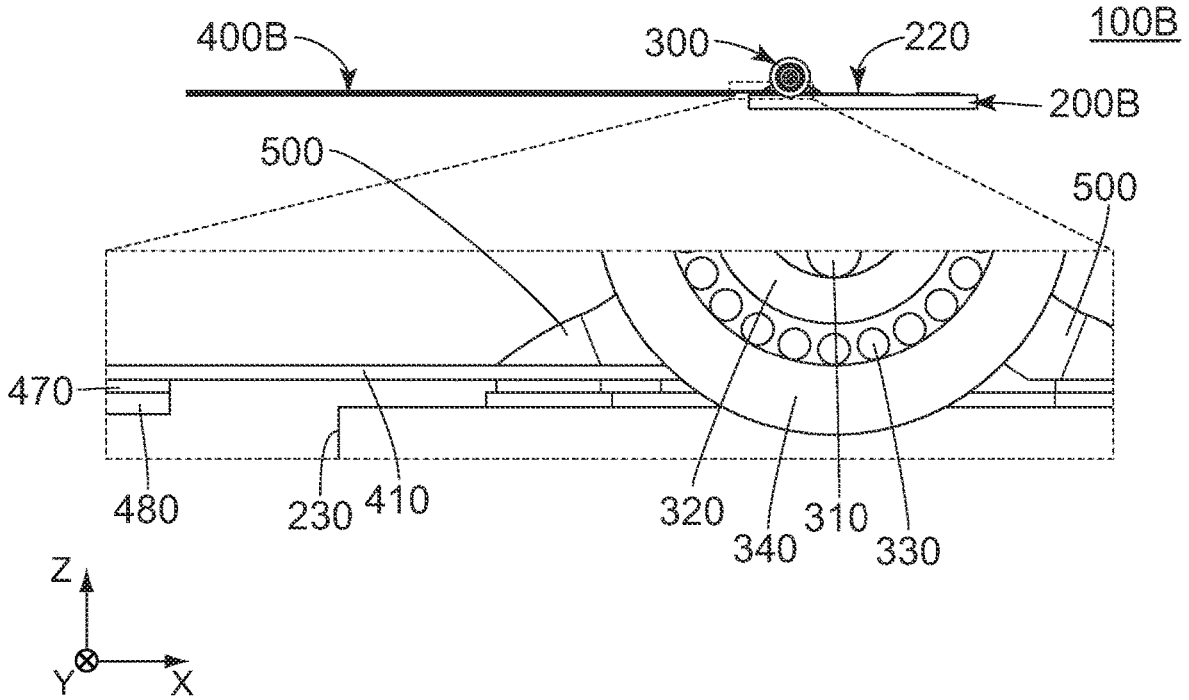
FIG. 24 is a side view showing the antenna assembly of FIG. 23. In the figure, a part of the antenna assembly is illustrated enlarged.
Figure 25:
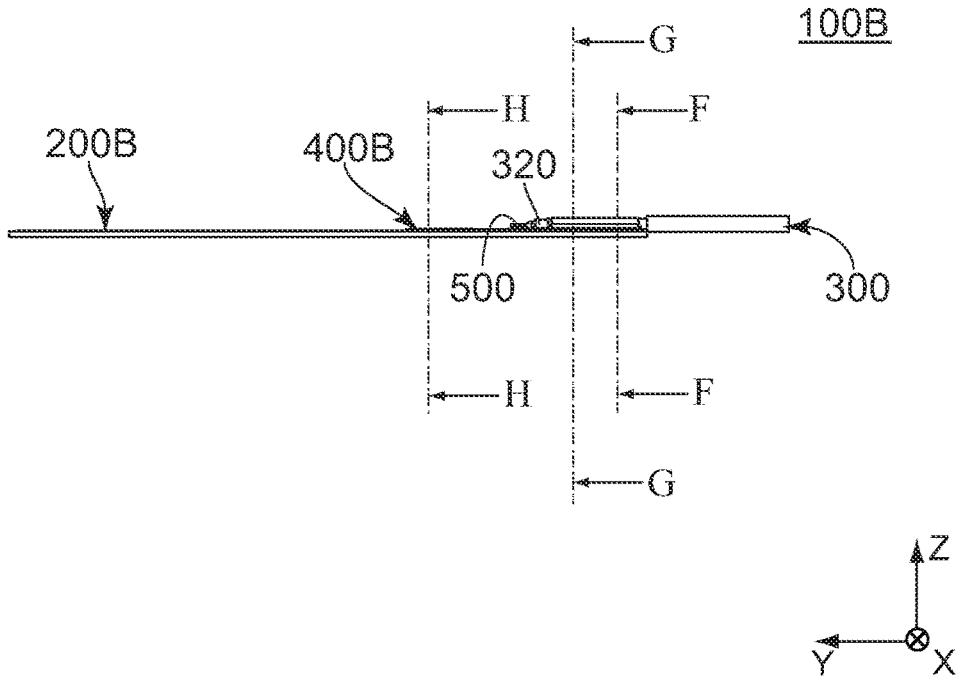
FIG. 25 is a rear view showing the antenna assembly of FIG. 23.

As shown in FIG. 22, an electronic equipment 700B according to a third embodiment of the present invention comprises an antenna assembly 1008 and a ground member 600. Similar to the ground member 600 of the first embodiment, the ground member 600 of the present embodiment is distinct and separated from the antenna assembly 1008.

As shown in FIG. 22, the antenna assembly 1008 according to the third embodiment of the present invention has a structure similar to those of the antenna assembly 100 of the aforementioned first embodiment as shown in FIG. 1 and the antenna assembly 100A of the aforementioned second embodiment as shown in FIG. 11. Components of the antenna assembly 1008 shown in FIGS. 22 to 32 which are same as those of the antenna assembly 100 of the first embodiment are referred by using reference signs same as those of the antenna assembly 100 of the first embodiment. In addition, components of the antenna assembly 1008 shown in FIGS. 22 to 32 which are same as those of the antenna assembly 100A of the second embodiment are referred by using reference signs same as those of the antenna assembly 100A of the second embodiment. As for directions and orientations in the present embodiment, expressions same as those of the first embodiment will be used hereinbelow.

As shown in FIG. 22, the antenna assembly 1008 of the present embodiment comprises a circuit board 200B, a coaxial cable 300 and a conductive film 400B. Specifically, the circuit board 200B is formed with an antenna 220. The coaxial cable 300 of the present embodiment has a structure same as that of the coaxial cable 300 of the first embodiment. Accordingly, a detailed explanation thereabout is omitted.

Figure 32:
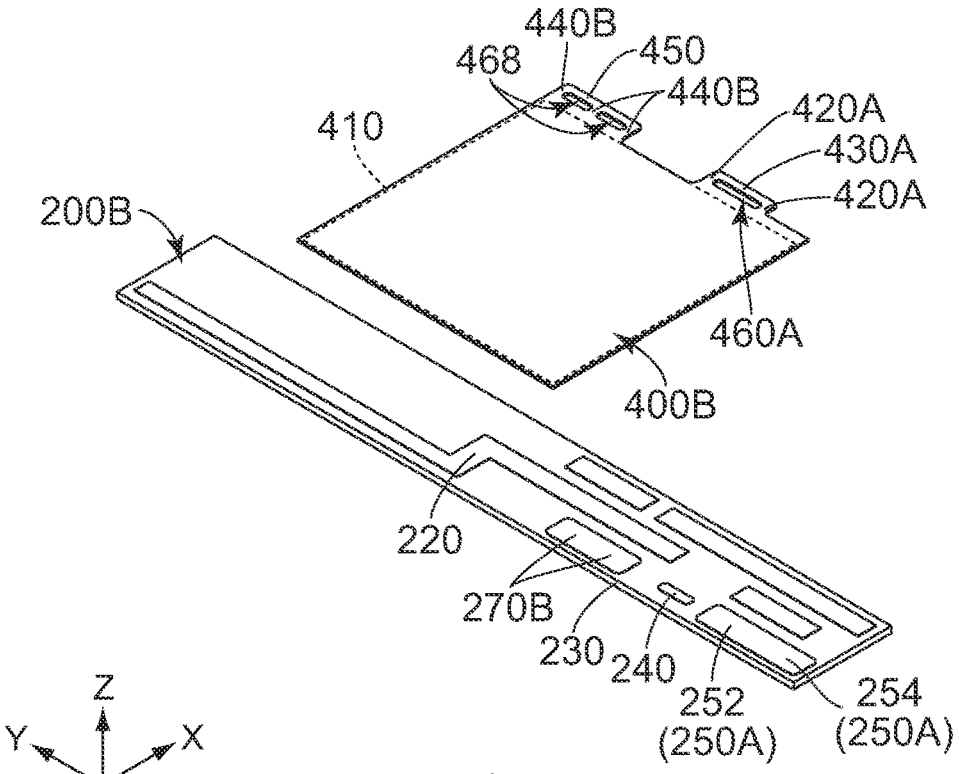
FIG. 32 is a perspective view showing the antenna assembly of FIG. 31. In the figure, the conductive film is not fixed on the circuit board.
Figure 33:
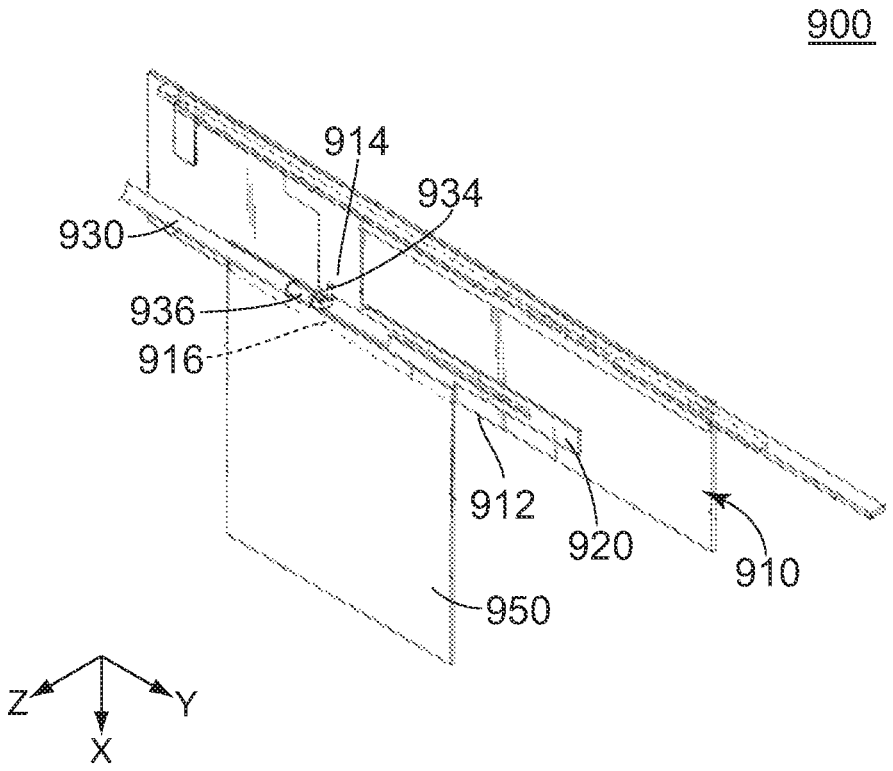
FIG. 33 PRIOR ART
FIG. 33 is a perspective view showing an antenna assembly of Patent Document 1.

Referring to FIG. 32, the circuit board 200B of the present embodiment has an upper surface, a ground layer (not shown) and vias (not shown). Specifically, the upper surface faces in an up-down direction. The ground layer is positioned below the upper surface in the up-down direction. The vias are connected with the ground layer.

As shown in FIG. 32, the circuit board 200B has a first pad 240, a second pad 250A and an edge 230. The second pad 250A of the present embodiment has a structure same as the second pad 250A of the second embodiment, and the edge 230 of the present embodiment have a structure same as any of those of the edges 230 of the aforementioned embodiments. Accordingly, detailed explanations thereabout are omitted.

As shown in FIG. 32, the circuit board 200B further has a third pad 270B.

As shown in FIG. 32, the third pad 270B of the present embodiment is provided on the upper surface of the circuit board 200B. All of the first pad 240, the second pad 250A and the third pad 270B are positioned on the common surface of the circuit board 200B. The third pad 270B is positioned rightward of the first pad 240 in the right-left direction. The first pad 240 is positioned between the second pad 250A and the third pad 270B in the first direction, or in the right-left direction. The third pad 270B is electrically connected with the second pad 250A. More specifically, the second pad 250A is connected with the ground layer through the vias, and the third pad 270B is connected with the ground layer through the vias. Thus, the second pad 250A and the third pad 270B are electrically connected with each other through the vias and the ground layer.

Figure 26:
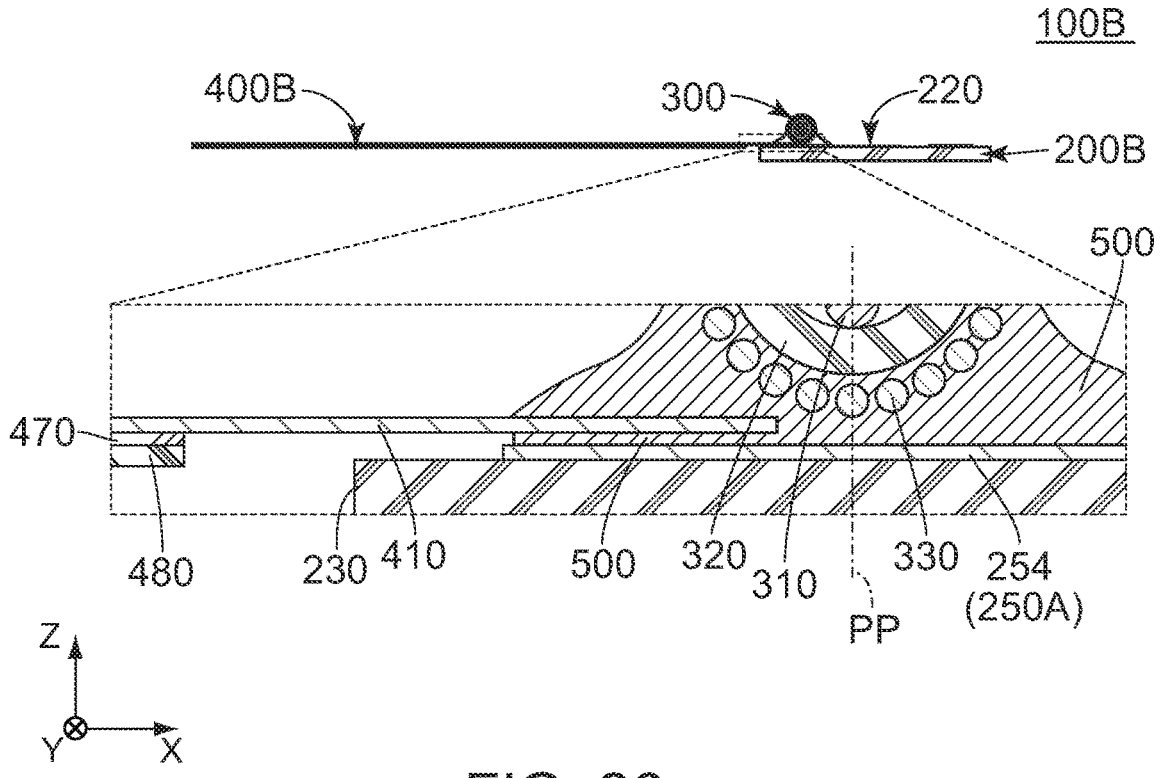
FIG. 26 is a cross-sectional view showing the antenna assembly of FIG. 25, taken along line F-F. In the figure, a part of the antenna assembly is illustrated enlarged.
Figure 27:
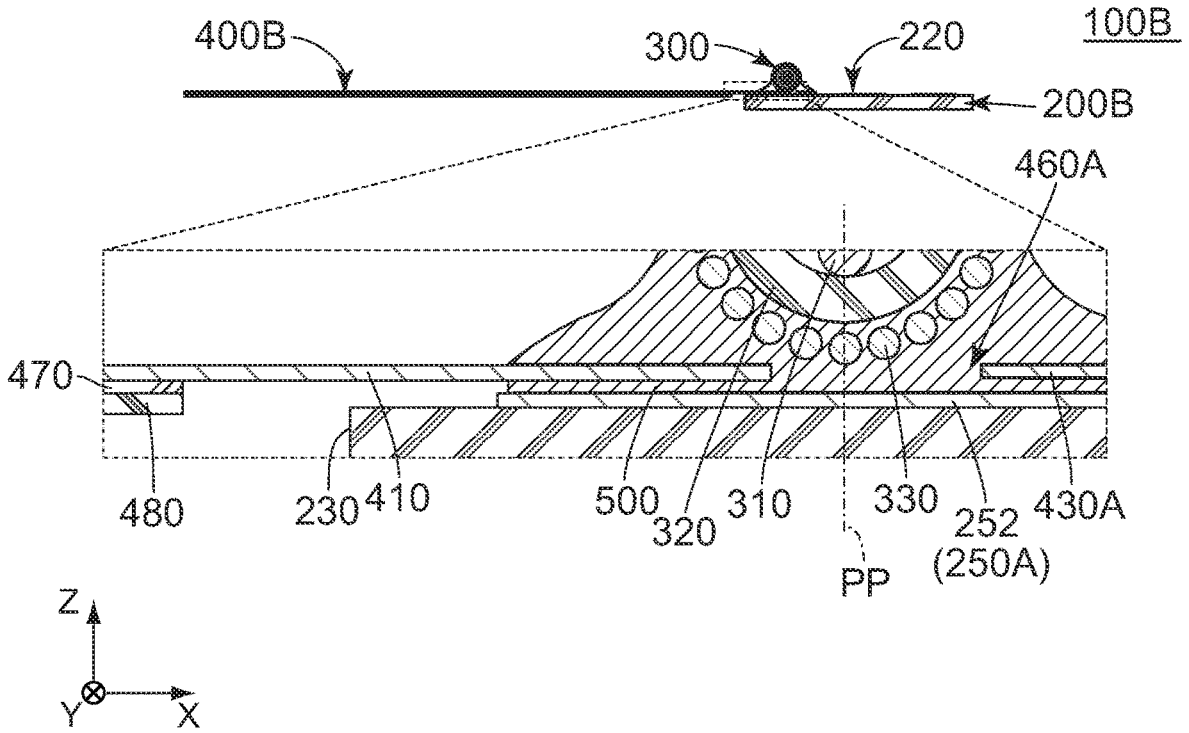
FIG. 27 is a cross-sectional view showing the antenna assembly of FIG. 25, taken along line G-G. In the figure, a part of the antenna assembly is illustrated enlarged.
Figure 28:
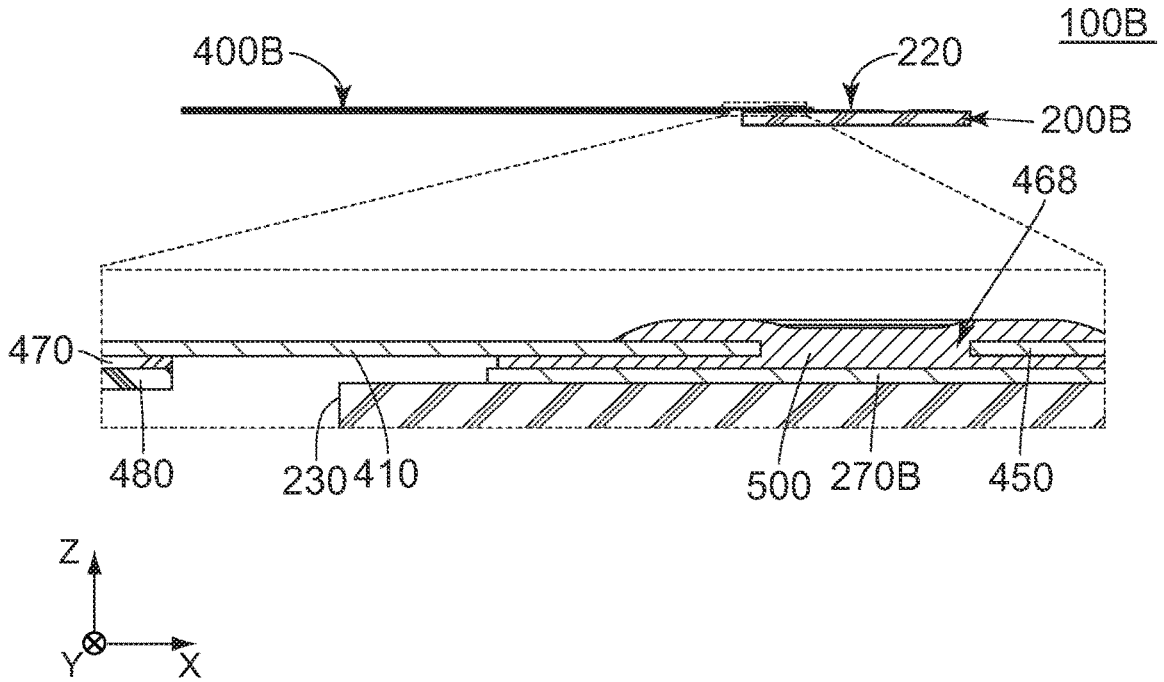
FIG. 28 is a cross-sectional view showing the antenna assembly of FIG. 25, taken along line H-H. In the figure, a part of the antenna assembly is illustrated enlarged.
Figure 29:
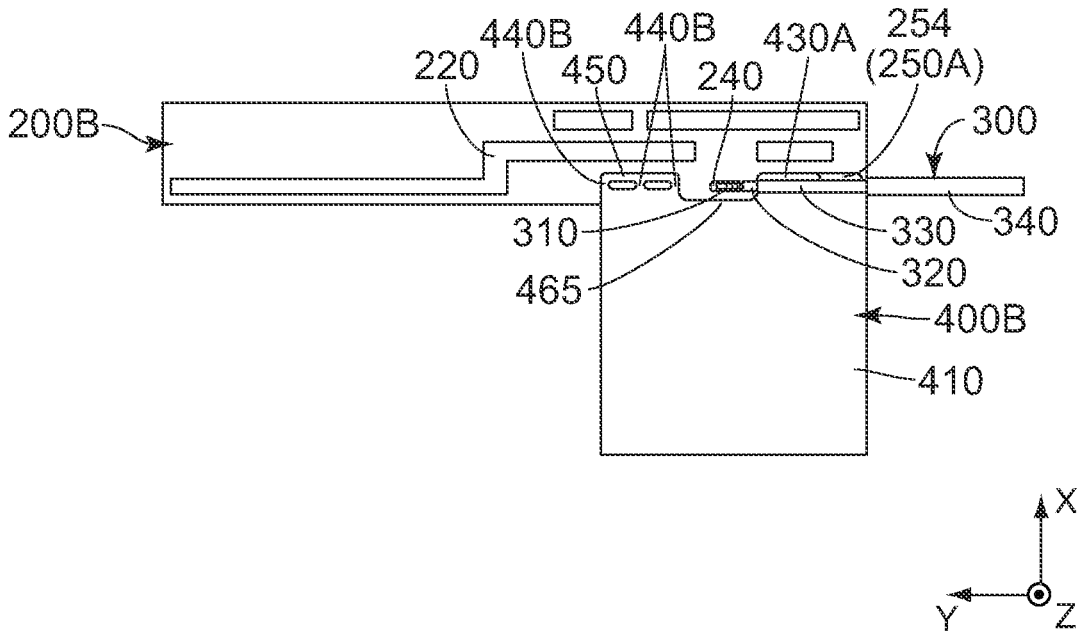
FIG. 29 is a top view for explaining an assembly method of the antenna assembly of FIG. 23. In the figure, a conductive film is fixed on a circuit board while a coaxial cable is not soldered to the circuit board.
Figure 30:
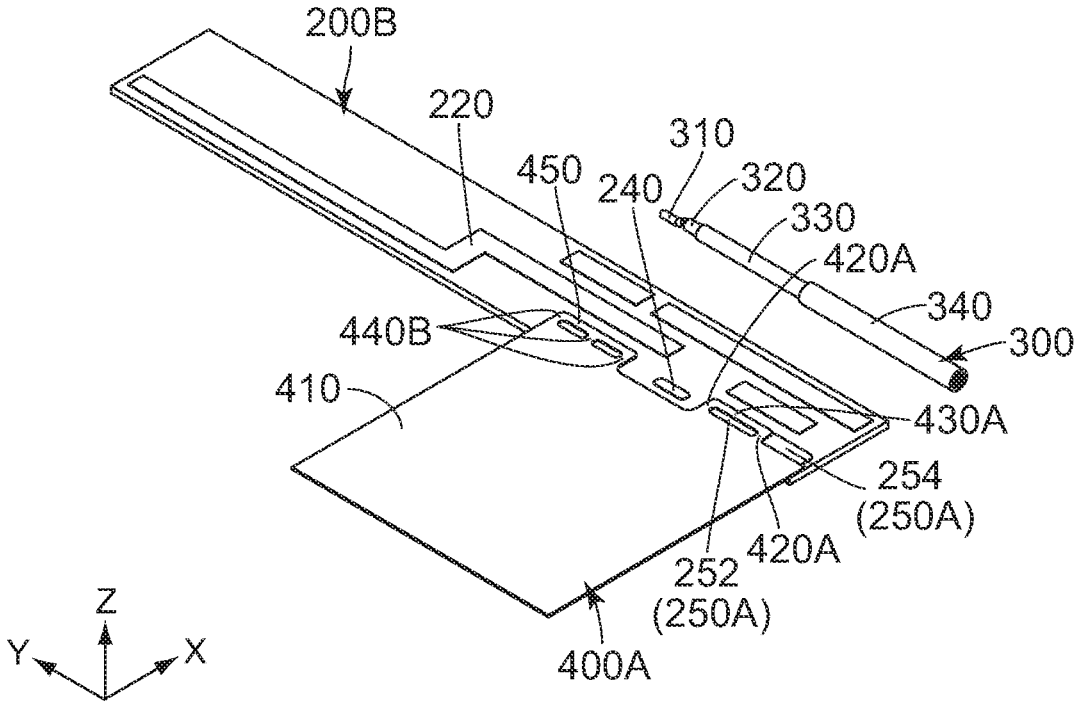
FIG. 30 is perspective view showing the antenna assembly of FIG. 29. In the figure, the conductive film is fixed on the circuit board while the coaxial cable is not soldered to the circuit board.

Referring to FIG. 22, the conductive film 400B of the present embodiment is a copper tape. However, the present invention is not limited thereto. The conductive film 400B may be made of conductive material other than a copper tape. The conductive film 400B is connected with the ground member 600. As shown in FIGS. 26 to 28, the conductive film 400B is fixed on the circuit board 200B. Dissimilar to the conductive films 400, 400A of the aforementioned embodiments, the conductive film 400B has no adhesive layer 470 at a portion which is configured to be fixed on the circuit board 200B. Specifically, the conductive film 400B is fixed on the circuit board 200B so that the adhesive layer 470 is not interposed between the conductive film 400B and the circuit board 200B.

Figure 31:
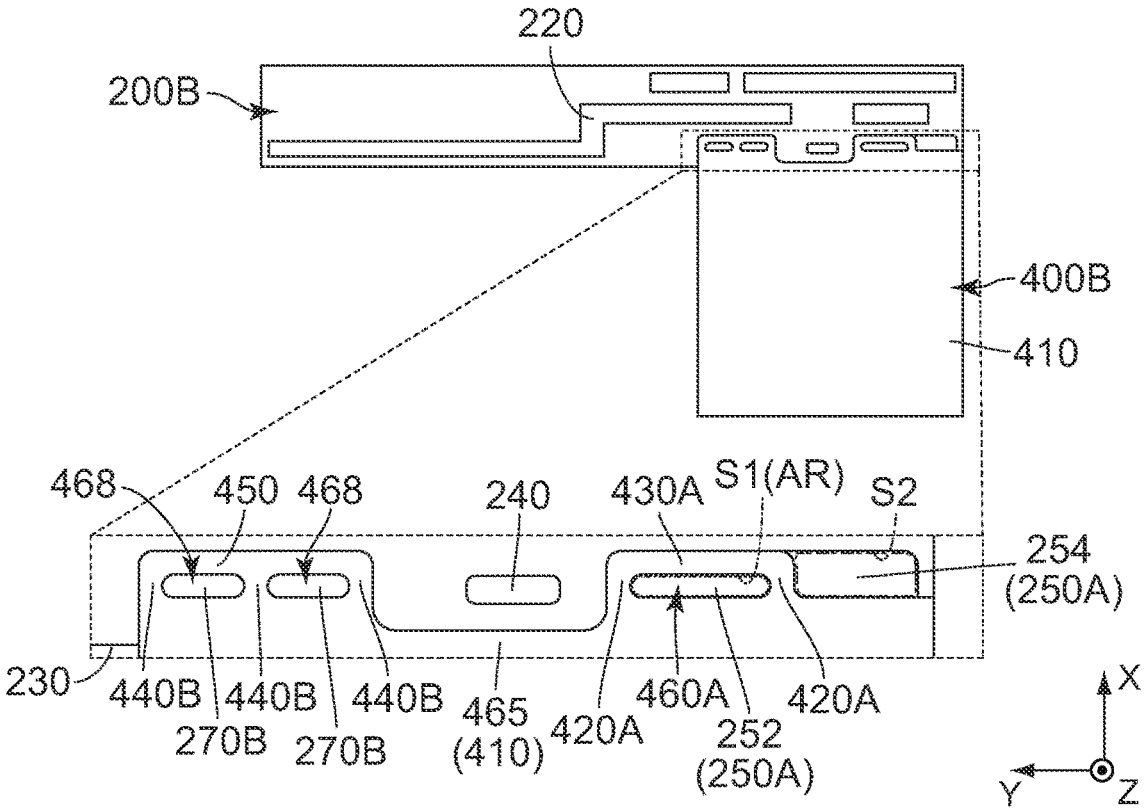
FIG. 31 is another top view for explaining the assembly method of the antenna assembly of FIG. 23. In the figure, the conductive film is not fixed on the circuit board, and parts of the circuit board and the conductive film are illustrated enlarged.

As shown in FIG. 31, the conductive film 400B has a main portion 410, extending portions 420A and a coupling portion 430A. The main portion 410 of the present embodiment has a structure same as that of the main portion 410 of the first embodiment. Accordingly, a detailed explanation thereabout is omitted. The extending portions 420A and the coupling portion 430A of the present embodiment have structures same as those of the extending portions 420A and the coupling portion 430A of the second embodiment. Accordingly, a detailed explanation thereabout is omitted.

As shown in FIG. 31, the conductive film 400B further has auxiliary extending portions 440B and an auxiliary coupling portion 450.

As shown in FIG. 31, the number of the auxiliary extending portions 440B of the present embodiment is three. The auxiliary extending portions 440B are positioned away from each other in the first direction. The third pad 270B is partially positioned between the auxiliary extending portions 440B. As understood from FIGS. 22 and 28, each of the auxiliary extending portions 440B is soldered on the third pad 270B. Specifically, each of the auxiliary extending portions 440B is indirectly connected with the third pad 270B through solder 500 which functions as a conductive member. The solder 500 is provided to connect the auxiliary extending portion 440B and the third pad 270B with each other. However, the present invention is not limited thereto. The auxiliary extending portion 440B may be directly connected with the third pad 270B by means of ultrasonic welding or the like. In other words, the auxiliary extending portion 440B should be directly connected with the third pad 270B or be indirectly connected with the third pad 270B through the conductive member which the antenna assembly 1008 further comprises. This enables a ground plane of the antenna assembly 1008 to be connected with the conductive film 400B so that AC current can flow between the ground plane of the antenna assembly 1008 and the conductive film 400B. Additionally, this also enables the ground plane of the antenna assembly 100B to be connected with the conductive film 400B so that DC current can flow between the ground plane of the antenna assembly 1008 and the conductive film 400B. Thus, the antenna 220 can have further improved antenna characteristics.

As shown in FIG. 31, the auxiliary coupling portion 450 of the present embodiment extends in the first direction, or in the right-left direction. The auxiliary coupling portion 450 couples the auxiliary extending portions 440B with each other at a location which is away from the main portion 410 in the second direction. Specifically, the auxiliary coupling portion 450 couples the auxiliary extending portions 440B with each other at a location which is forwardly away from the main portion 410 in the front-rear direction. The auxiliary coupling portion 450 couples all of the auxiliary extending portions 440B with each other.

As shown in FIG. 31, the main portion 410, the auxiliary extending portions 440B and the auxiliary coupling portion 450 form two auxiliary holes 468. In other words, the conductive film 400B has the two auxiliary holes 468. Each of the auxiliary holes 468 pierces the conductive film 400B in the up-down direction. However, the present invention is not limited thereto. The conductive film 400B may have no auxiliary hole 468. If the conductive film 400B has no auxiliary hole 468, the number of the auxiliary extending portion 440B should be one.

As shown in FIG. 28, an interior space of each of the auxiliary holes 468 is filled with solder 500.

Hereinafter, a detailed description will be made about an example of an assembly method of the antenna assembly 1008.

First, referring to FIGS. 26, 27, 28, 30 and 32, the conductive film 400B is temporarily placed, by using a positioning jig (not shown), on the upper surface of the circuit board 200B so that the main portion 410 is arranged to extend across the edge 230 of the circuit board 200B. Thus, the circuit board 200B and the conductive film 400B result in a state shown in FIG. 30.

Next, the coaxial cable 300 is temporarily placed on the conductive film 400B, which is temporarily placed on the circuit board 200B, so that a center conductor 310 is placed on the first pad 240 while an outer conductor 330 is placed on the second pad 250A. Meanwhile, in a predetermined area PA as shown in FIG. 22, the extending portions 420A and the second pad 250A are aligned in the first direction, or in the right-left direction. Also meanwhile, each of the extending portions 420A extends from the main portion 410 over a predetermined position PP as shown in FIG. 22 in the second direction, or in the front-rear direction. Thereafter, the center conductor 310 and the first pad 240 are bonded to each other by solder 500, the outer conductor 330 and the second pad 250A are bonded to each other by solder 500, and the auxiliary extending portions 440B and the third pad 270B are bonded to each other by the solder 500. Thus, the conductive film 400B is fixed on the circuit board 200B so that the assembling of the antenna assembly 1008 is completed.

Especially, in the aforementioned assembly process, the conductive film 400B is temporarily placed on the circuit board 200B so that the extending portions 420A and the second pad 250A are aligned in the first direction in the predetermined area PA while each of the extending portions 420A extends from the main portion 410 over the predetermined position PP in the second direction. Accordingly, the conductive film 400B has a portion of increased size which is temporarily placed on the circuit board 200B when the conductive film 400B is fixed on the circuit board 200B. Thus, the antenna assembly 1008 of the present embodiment can facilitate operation of fixing the conductive film 400B on the circuit board 200B.

Although the specific explanation about the present invention is made above referring to the embodiments, the present invention is not limited thereto and is susceptible to various modifications and alternative forms. In addition, the above embodiments and variations may also be combined.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna assembly comprising a circuit board formed with an antenna, a coaxial cable and a conductive film, wherein:

the circuit board has an edge, a first pad and a second pad;

the coaxial cable comprises a center conductor, an insulator, an outer conductor and an outer cover;

the center conductor is connected with the first pad;

the outer conductor is insulated from the center conductor by the insulator;

the outer conductor has an exposed portion;

the exposed portion of the outer conductor is exposed from the outer cover over a predetermined area;

the exposed portion of the outer conductor extends in a first direction;

the exposed portion of the outer conductor is connected with the second pad;

in a second direction perpendicular to the first direction, a center of the coaxial cable is positioned at a predetermined position;

the conductive film is fixed on the circuit board;

the conductive film has a main portion and at least one extending portion;

in the predetermined area, the at least one extending portion and the second pad are aligned in the first direction;

the at least one extending portion extends from the main portion over the predetermined position in the second direction;

the exposed portion of the outer conductor and the at least one extending portion are aligned in an up-down direction perpendicular to both the first direction and the second direction;

the exposed portion of the outer conductor is positioned between the first pad and the outer cover in the first direction; and the exposed portion of the outer conductor is positioned just above the at least one extending portion in the up-down direction.

2. The antenna assembly as recited in claim 1, wherein:

the at least one extending portion includes a plurality of the extending portions;

the extending portions are positioned away from each other in the first direction;

the conductive film further has a coupling portion;

the coupling portion couples the extending portions with each other at a location which is away from the main portion in the second direction; and the second pad and the outer conductor are connected with each other at least between the extending portions.

3. The antenna assembly as recited in claim 2, wherein:

the at least one extending portion includes three or more of the extending portions; and the coupling portion couples all of the extending portions with each other.

4. The antenna assembly as recited in claim 2, wherein:

the second pad is provided with a first portion and a second portion;

the first portion is positioned between the first pad and the second portion in the first direction;

the first portion is positioned in a region which is surrounded by the extending portions and the coupling portion; and the outer conductor is connected with both of the first portion and the second portion.

5. The antenna assembly as recited in claim 1, wherein:

the center conductor is soldered to the first pad; and the outer conductor is soldered to the second pad.

6. The antenna assembly as recited in claim 1, wherein:

the circuit board further has a third pad;

the first pad is positioned between the second pad and the third pad in the first direction;

the third pad is electrically connected with the second pad;

the conductive film further has at least one auxiliary extending portion;

the at least one auxiliary extending portion extends from the main portion over the predetermined position in the second direction; and the at least one auxiliary extending portion is directly connected with the third pad or is indirectly connected with the third pad through a conductive member which the antenna assembly further comprises.

7. The antenna assembly as recited in claim 6, wherein:

the at least one auxiliary extending portion is soldered to the third pad; and the solder functions as the conductive member.

8. The antenna assembly as recited in claim 7, wherein:

the at least one auxiliary extending portion includes a plurality of the auxiliary extending portions;

the auxiliary extending portions are positioned away from each other in the first direction;

the conductive film further has an auxiliary coupling portion;

the auxiliary coupling portion couples the auxiliary extending portions with each other at a location which is away from the main portion in the second direction;

the third pad is partially positioned between the auxiliary extending portions; and the solder is provided to connect the auxiliary extending portion and the third pad with each other.

9. The antenna assembly as recited in claim 1, wherein the main portion is arranged to extend across the edge.

10. The antenna assembly as recited in claim 1, wherein:

the conductive film has an adhesive layer; and the conductive film is fixed on the circuit board via the adhesive layer.

11. The antenna assembly as recited in claim 1, wherein:

the conductive film has an adhesive layer; and the conductive film is fixed on the circuit board so that the adhesive layer is not interposed between the conductive film and the circuit board.

12. An electronic equipment comprising the antenna assembly recited in claim 1 and a ground member, wherein:

the ground member is distinct and separated from the antenna assembly; and the conductive film is connected with the ground member.

* * * * *